US010344957B2

(12) United States Patent
Crosby

(10) Patent No.: US 10,344,957 B2
(45) Date of Patent: Jul. 9, 2019

(54) LIGHTING FIXTURES

(71) Applicant: Boyd Lighting Fixture Company, Sausalito, CA (US)

(72) Inventor: Doyle Crosby, San Rafael, CA (US)

(73) Assignee: Boyd Lighting Fixture Company, Sausalito, CA (US)

( * ) Notice: Subject to any disclaimer, the term of this patent is extended or adjusted under 35 U.S.C. 154(b) by 0 days.

(21) Appl. No.: 15/812,755

(22) Filed: Nov. 14, 2017

(65) Prior Publication Data

US 2019/0145612 A1 May 16, 2019

(51) Int. Cl.

| | |
|---|---|
| ***F21V 5/04*** | (2006.01) |
| ***F21V 21/116*** | (2006.01) |
| ***F21V 21/26*** | (2006.01) |
| ***F21V 21/005*** | (2006.01) |
| ***F21S 8/00*** | (2006.01) |
| ***F21S 8/04*** | (2006.01) |
| ***F21V 5/00*** | (2018.01) |
| *F21Y 115/10* | (2016.01) |
| *F21Y 113/20* | (2016.01) |

(52) U.S. Cl.

CPC ..... *F21V 21/116* (2013.01); *F21S 8/036* (2013.01); *F21S 8/043* (2013.01); *F21V 5/002* (2013.01); *F21V 21/005* (2013.01); *F21V 21/26* (2013.01); *F21Y 2113/20* (2016.08); *F21Y 2115/10* (2016.08)

(58) Field of Classification Search

CPC ..... F21V 21/116; F21V 5/002; F21V 21/005; F21V 21/26; F21S 8/036; F21S 8/043; F21Y 2113/20; F21Y 2115/10

USPC ..... 362/245, 23.19, 232

See application file for complete search history.

(56) References Cited

U.S. PATENT DOCUMENTS

| | | | |
|---|---|---|---|
| D441,119 | S | 4/2001 | Crosby |
| D442,317 | S | 5/2001 | Crosby |
| D456,550 | S | 4/2002 | Clodagh |
| D532,146 | S | 11/2006 | Crosby |
| D532,147 | S | 11/2006 | Crosby |

(Continued)

OTHER PUBLICATIONS

Boyd Lighting Fixture Company email, "For the love of mid century modem. See the best from Instagram.", 6 pages, Jan. 23, 2018, 6 pages.

(Continued)

*Primary Examiner* — Karl D Frech

(74) *Attorney, Agent, or Firm* — Heslin Rothenberg Farley and Mesiti PC

(57) ABSTRACT

Lighting fixture include an elongated support and at least one lighting element. The support operably attachable to a wall or a ceiling. The least one lighting element includes a lighting unit and a continuous surrounding member. The continuous surrounding member has an inner surface and an outer surface defining a first opening and a second opening. The elongated support extends through a first portion of the surrounding member spaced from the first opening and spaced from the second opening and extends through a second portion of the surrounding member spaced from the first opening and spaced from the second opening. The lighting unit is disposed in a cavity and spaced from the inner surface of the surrounding member to define a surrounding area between the lighting unit and the inner surface of the surrounding member.

49 Claims, 33 Drawing Sheets

(56) References Cited

U.S. PATENT DOCUMENTS

| | | | | |
|---|---|---|---|---|
| D536,468 | S | 2/2007 | Crosby | |
| D558,912 | S | 1/2008 | Crosby | |
| 7,563,980 | B2 * | 7/2009 | Wimberly | H02G 3/14 174/58 |
| D604,886 | S | 11/2009 | Rugee | |
| D612,535 | S | 3/2010 | Fisher et al. | |
| D615,697 | S | 5/2010 | Otero | |
| D646,426 | S | 10/2011 | Wolk | |
| 8,342,718 | B2 * | 1/2013 | Kikoski | F21S 8/061 362/23.19 |
| D700,734 | S | 3/2014 | Chan | |
| 8,714,775 | B2 | 5/2014 | Bracher et al. | |
| 2007/0183151 | A1 * | 8/2007 | Joseph | F21S 8/00 362/232 |

OTHER PUBLICATIONS

Paul Kaplan Group on Instragram, 1 image, printout available online on Jan. 19, 2018, https://www.instagram.com/p/Belyr8SDE5y/?hl=en&taken-by=paulkaplangroup&utm_source=Master+List&utm_campaign=2dd0975551-January+23_eblast_Totem+inspiration&utm_medium=email&utm_term=0_24f09d4f71-2dd0975551-80864985&mc_cid=2dd0975551&mc_eid=0a262eeef, 2 pages, Jan. 19, 2018.

Walker Zanger on Instragram, 1 image, printout available online on Jan. 25, 2018, at https://www.instagram.com/p/BZAHYOMHkzD/?hl=en&taken-by=walkerzanger&utm_source=Master+List&utm_campaign=2dd0975551-January+23_eblast_Totem+inspiration&utm_medium=email&utm_term=0_24f09d4f71-2dd0975551-80864985&mc_cid=2dd0975551&mc_eid=0a 262eeef, 2 pages, Sep. 13, 2017.

Vicente de Paulo on Instragram, 1 image, printout available online on Jan. 25, 2018, at https://www.instagram.com/p/BdnlAZklbDW/?hl=en&taken-by=vicentedepaulorio, 2 pages, Jan. 6, 2018.

Walkway Ipanema Beach, 1 image, printout available online on Jan. 26, 2018, at http://www.alamy.com/stock-photo-patterned-walkway-of-ipanema-beach-rio-de-janeiro-brazil-40203153.html, 1 page, Jul. 2011.

Dan Howarth, "AvroKO's interiors for Calistoga Motor Lodge and Spa look like 'a fictitious Wes Anderson film'", printout available online on Jan. 26, 2018, at https://www.dezeen.com/2017/10/20/avroko-interiors-renovation-calistoga-motor-lodge-spa-napa-vallery-fictitious-wes-anderson-film/, 10 pages, Oct. 20, 2017.

Explore Retro Design, Vintage Logo Design, and morel, printout available online on Nov. 8, 2017, https://www.pinterest.com/pin/299207968979734969/, 12 pages, at least as early as Nov. 8, 2017.

1950s Design, printout available online on Nov. 8, 2017, https://www.pinterest.com/explore/1950s-design/, 7 pages, at least as early as Nov. 8, 2017.

* cited by examiner

LIGHTING FIXTURES

FIELD OF THE DISCLOSURE

The present disclosure relates generally to lighting fixtures, and more particularly to lighting fixtures such as wall sconces and pendants having an elongated support supporting one or more lighting elements having a lighting unit and a surrounding member.

BACKGROUND

Sconces are lighting fixtures affixed to a wall in such a way that it uses only the wall for support, and the light is usually directed upwards, or downwards, and sometimes upwards and downwards. Sconces may be a traditional torch, candle or gas light, or an electric light source.

Chandeliers and pendants are lighting fixtures that hang from a ceiling. Typically, a chandelier or a pendant light is supported from a ceiling mount by a cord, chain, or pipe with an upper end attached to the ceiling mount, and a lower end attached to the lighting fixture. A chandelier or a pendant light often include one or more shades and one or more lights such as one or more light bulbs.

SUMMARY

Shortcomings of the prior art are overcome and additional advantages are provided through the provision, in one embodiment, of a lighting fixture having an elongated vertical support and at least one lighting element. The elongated vertical support includes a first end portion and a second end portion and defines a vertical axis. The support operably attachable to a wall or a ceiling. The least one lighting element includes a lighting unit and a continuous surrounding member. The lighting unit is operably connected to the elongated support between the first end portion and the second end portion. The continuous surrounding member has an inner surface and an outer surface defining a first opening and a second opening. The inner surface defines a cavity therein between the first opening and the second opening, the first opening and the second opening defines a central axis extending therethrough, and the central axis is disposed at a non-parallel angle relative to the first axis. The elongated support extends through a first portion of the surrounding member spaced from the first opening and spaced from the second opening and extends through a second portion of the surrounding member spaced from the first opening and spaced from the second opening. The lighting unit is disposed in the cavity and spaced from the inner surface of the surrounding member to define a surrounding area between the lighting unit and the inner surface of the surrounding member.

BRIEF DESCRIPTION OF THE DRAWINGS

The subject matter which is regarded as the disclosure is particularly pointed out and distinctly claimed in the concluding portion of the specification. The disclosure, however, may best be understood by reference to the following detailed description of various embodiments and the accompanying drawings in which:

DETAILED DESCRIPTION

Figure 1:
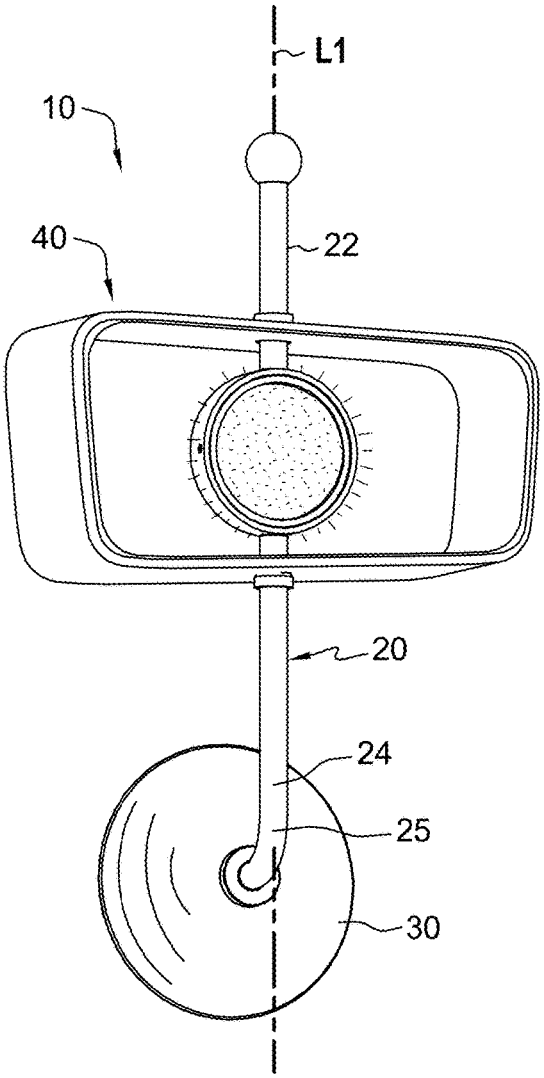
FIG. 1 is a perspective view of a lighting fixture according to an embodiment of the present disclosure with the lighting fixture disposed in a first configuration.

The present disclosure and certain features, advantages, and details thereof, are explained more fully below with reference to the non-limiting embodiments illustrated in the accompanying drawings. Descriptions of well-known materials, fabrication tools, processing techniques, etc., are omitted so as to not unnecessarily obscure the disclosure in detail. It should be understood, however, that the detailed description and the specific examples, while indicating embodiments of the present disclosure, are given by way of illustration only, and are not by way of limitation. Various substitutions, modifications, additions and/or arrangements within the spirit and/or scope of the underlying concepts will be apparent to those skilled in the art from this disclosure. Reference is made below to the drawings, which are not drawn to scale for ease of understanding, wherein the same reference numbers used throughout different figures designate the same or similar components.

The present disclosure is generally directed to lighting fixtures having an elongated support with one or more lighting elements having a lighting unit and a surrounding member. For example, lighting fixtures according to embodiments of the present disclosure may include one or more spaced-apart lighting elements supported on an elongated support and adjustment of at least a portion of the lighting element to allow independent adjustment of the one or more portions of the lighting fixture so that the lighting fixtures may be disposed in a range of different fixed configurations.

For example, the present disclosure may include in some embodiments pendants and sconces having open, formed or molded shapes or surrounding member in multiple sizes. In some embodiments, the open shapes of the forms may be asymmetric trapezoids and symmetric ovals, sometimes both, mixed together to make unique, vertical lighting fixtures and wall sconces. The forms or surrounding members may be made by forming metal, or casting metal or resin or other materials. The exterior of the formed or cast shapes may have colors, e.g., black, white, or other colors, with the interior surfaces of the formed or cast shapes being an either a corresponding color or gold, silver, brass and other hand-applied leaf. Some of the embodiments may result in a single lighting element or a series of forms or surrounding members that is organic, has minimal lines with soft edges, and a transparent mass. Within each of the shaped or cast forms (trapezoids, ovals, or other configurations), the illumination or lighting source may be housed in a sphere such as an acrylic sphere, comprised of two halves, held together by a metal ring or band. The light source may be two LEDs disposed within the sphere, each one facing the opposite direction, to ensure that the light is omni directional from the sphere and reflecting off of the inside of the casting without significant lamp imaging. When the inside of the casting is gold leafed, the light is noticeably brighter, and allows the inside of the casting to exude a warm glow, while each LED may provide a pin light at the center of the acrylic orb. When the inside of the casting is white on the interior, there is more reflected light available as ambient light.

The present disclosure may include a variety of modular-like compositions, such as a single stem with one or more, shaped or cast forms (trapezoid, oval or a mix of both, or other configurations), a linear pendant with one or more shaped or cast forms (trapezoid, oval or a mix of both, or other configurations), staggered-length stems with one or more shaped or cast forms (trapezoid, oval or a mix of both, or other configurations), a round pendant with a plurality of staggered stems with one or more shaped or cast forms (trapezoid, oval, a mix of both, or other configurations), a left or right trapezoid single sconce with one cast or shaped form, a single sconce with one oval cast or shaped form, or a triple sconce with three cast or shaped forms (trapezoid, ovals, mixed, or other configurations).

Figure 2:
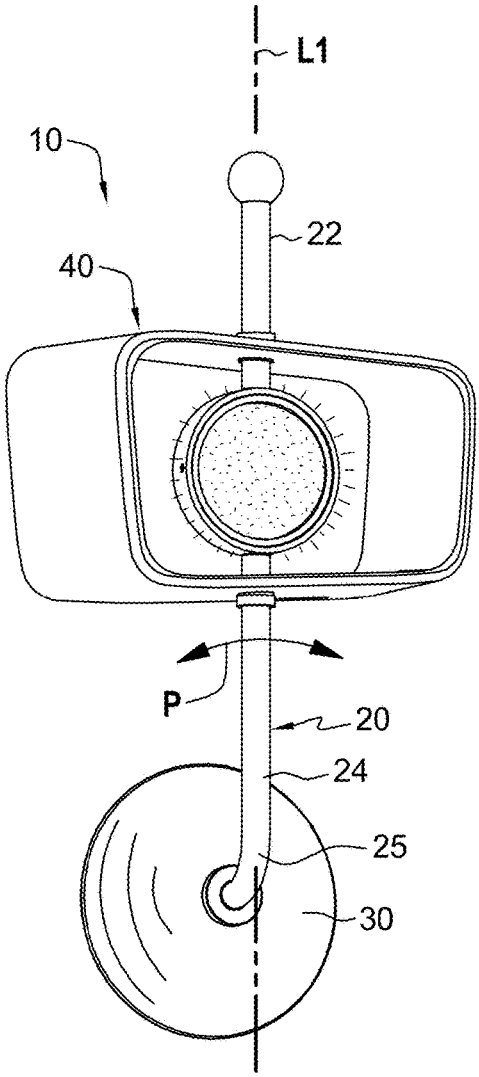
FIG. 2 is another perspective view of the lighting fixture of FIG. 1 with the lighting fixture disposed in a second configuration.

FIG. 1 illustrates a lighting fixture 10 such as a wall sconce according to an embodiment of the present disclosure in which lighting fixture 10 is disposed in a first configuration. FIG. 2 illustrates lighting fixture 10 disposed in a second configuration with for example one or more portions or components of the lighting fixture being adjustable such as movable or rotatable. As shown in FIG. 2, a portion or component of a lighting element 40 of lighting fixture 10 may be movable or rotatable in the direction of curved arrow P. As described below, one or more portions or components of the lighting fixture may be movable or rotatable over a range of positions so that the lighting fixture is operable to have a plurality of different configurations.

With reference to FIGS. 1 and 2, lighting fixture 10 may generally include a support member 20, a wall mount 30, and lighting element 40. Wall mount 30 may allow operably attaching the lighting fixture to a wall. The lighting fixture may also be operably connectable to electrical power in a home or other building. For example, electrical power may typically be provided to the lighting fixture by electrical wires or cables such as conventional 120 or 240 volt AC power from the local electrical grid. Alternatively, electrical power may be provided by one or more batteries.

Support member 20 may include a first end portion 22 and a second end portion 24 such as an upper end portion and a lower end portion. Support member 20 may include a generally straight main portion defining a generally longitudinal straight axis L1. For example, in this illustrated embodiment, the main portion of the support may include a vertically disposed elongated support straight portion defining a longitudinal axis disposed along a first direction such as a vertical direction. Support member 20 may include a curved portion 25 connectable to wall mount and allowing main support portion of support member 20 to be disposed vertically. The support may have a diameter or thickness of about 0.25 inch, about 0.5 inch, about 0.75 inch, about 1 inch, about 1.5 inches, about 2 inches, about 3 inches, or more, in the range between about 0.25 inch to about 3 inches, between about 0.5 inch and about 2 inches, between about 0.75 inch and about 1.5 inches, or other suitable diameter or thickness. The length of the support may be about 12 inches, about 15 inches, about 20 inches, about 24 inches, or more, in the range between about 12 inches to about 24 inches, between about 12 inches and about 20 inches, between about 15 inch and about 24 inches, or other suitable length.

Figure 3:
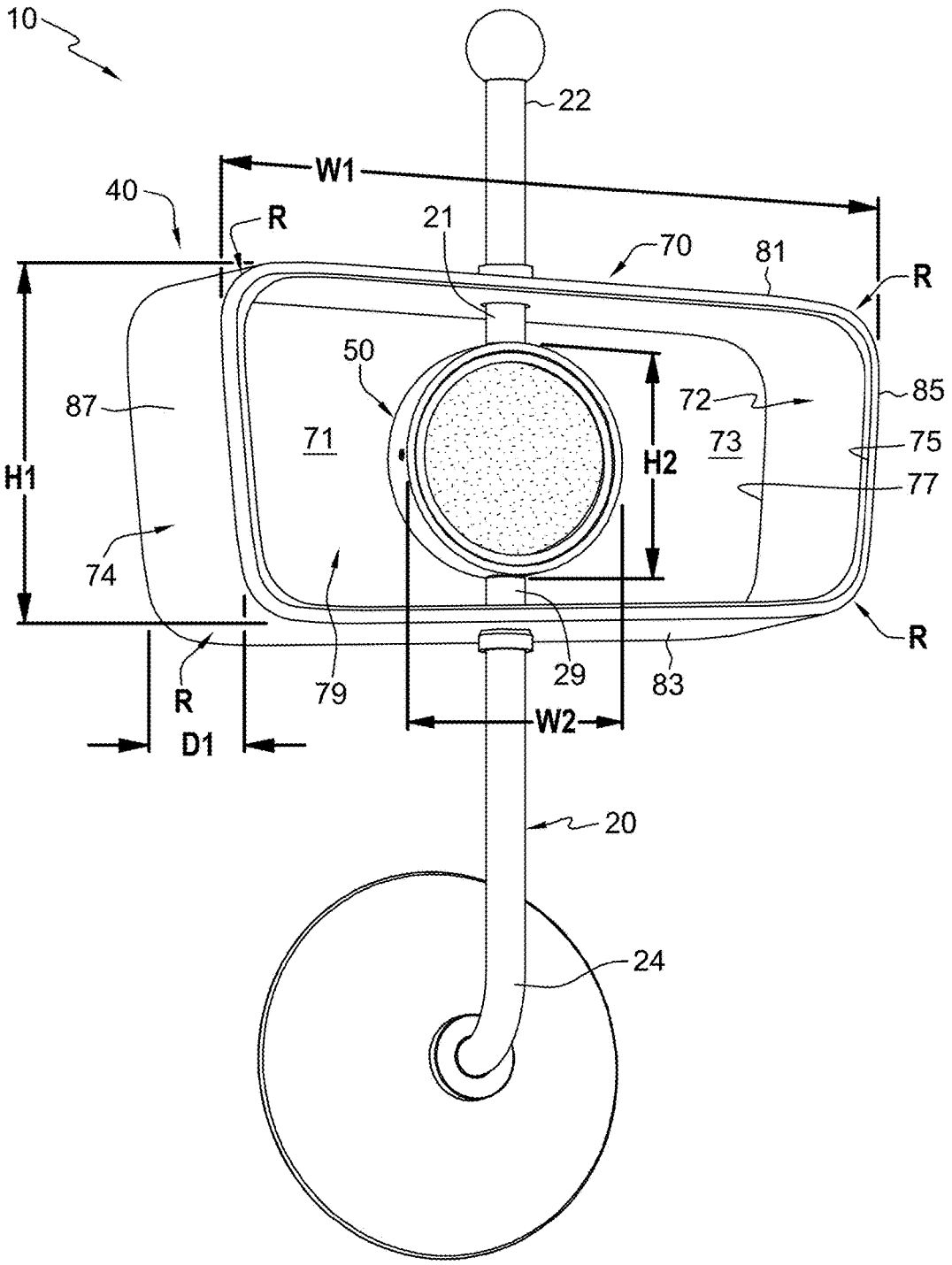
FIG. 3 is an enlarged perspective view of the lighting fixture of FIG. 1.

As shown in FIG. 3, lighting element 40 generally includes a lighting unit 50 and a surrounding member 70.

Surrounding member 70 includes an inner surface 72 and an outer surface 74 defining a first opening 75 and a second opening 77. Inner surface 72 defines a cavity 79 therein between first opening 75, inner surface 72, and second opening 77. In this illustrated embodiment, the surrounding member is a continuous surrounding member that extends continuously around lighting unit 50. The surrounding member may have a width W1 about 5 inches, about 6 inches, about 9 inches, about 10 inches, about 12 inches, about 15 inches, about 20 inches, about 24 inches, about 25 inches or more, in the range between about 5 inches to about 25 inches, between about 9 inches to about 25 inches, between about 6 inches to about 20 inches, or other suitable width, a height H1 of about 2 inches, about 4 inches, about 5 inches, about 6 inches, about 10 inches, about 12 inches, about 15 inches, about 20 inches, about 24 inches, about 25 inches or more, in the range between about 2 inches to about 25 inches, between about 6 inches to about 20 inches, between about 4 inches to about 12 inches, or other suitable height, and a depth D1 of about 1 inch, about 2 inches, about 3 inches, about 5 inches, about 6 inches, about 10 inches, about 12 inches, about 15 inches, about 20 inches, about 24 inches or more, in the range between about 1 inch to about 24 inches, between about 2 inches to about 15 inches, between about 3 inches to about 12 inches, between about 4 inches to about 10 inches, or other suitable depth.

As illustrated, surrounding member 70 may have a rectangular, trapezoidal, irregular rectangular, or irregular trapezoidal cross-section with rounded corners R. For example, surrounding member 70 may have a generally horizontal upper portion 81, a generally horizontal lower portion 83, a generally vertical right side portion 85, and a generally vertical left side portion 87. In the illustrated embodiment shown in FIG. 3, upper portion 81 and lower portion 83 may be disposed at an angle relative to each other, e.g., upper portion 81 and lower portion 83 may angle away from each other towards the left side, and right side portion 85 and left side portion 87 may be disposed at an angle relative to each other, e.g., left side portion 85 and right side portion 87 may angle away from each other towards the upper portion. The angled sides may be disposed as an angle relative to horizontal or horizontal. For example, opposite angled sides may be about 1 degree to about 10 degrees, about 2 degrees to about 8, about 3 degrees to about 6, about 1 degree, 2 degrees, about 3 degrees, about 4 degrees, about 5 degrees, about 6 degrees, or at other suitable angles relative to each other.

Surrounding member 70 may be a continuous surrounding member, may be a thin flat surrounding member, and may be opaque. For example, surrounding member 70 may have a thickness of about 0.1 inch, about 0.125 inch, about 0.2 inch, about 0.25 inch, about 0.375 inch, about 0.5 inch, about 0.75 inch, about 1 inch, about 2 inches or more inches, in a range between about 0.1 inch to about 2 inches, in a range between about 0.1 inch to about 1 inch, in a range between about 0.1 inch to about 0.5 inches, in a range between about 0.2 inch to about 0.5 inches, or other suitable thickness. The thickness may be constant of the surrounding member may be constant. In some embodiments, the thickness of the surrounding member may vary.

Elongated support member 20 may extend through a first portion such as an upper portion of surrounding member 70 between first opening 75 and second opening 77, and may extend through a second portion such a lower portion of surrounding member 70 between first opening 75 and second opening 77. A portion 21 of the elongated support may extend between lighting unit 50 and inner upper portion of inner surface 72, and a portion 29 of the elongated support may extend between lighting unit 50 and inner lower portion of inner surface 72. The lighting unit and the support member may form an integral appearance.

Lighting unit 50 is operably connected to elongated support member 20 between first end portion 22 and second end portion 24, and disposed in cavity 79 and spaced from inner surface 72 of surrounding member 70. In some embodiments, the lighting unit may be disposed in the center of surrounding member 70. The configuration of lighting unit 10 with lighting unit 50 generally disposed within surrounding member 40 may result in vacant open portions 71 and 73 disposed on opposite sides between lighting unit 50 and a right side and a left side of surrounding member 40, and that extend from first front opening 75 and second rear opening 77. In some embodiments, the volume the vacant open portions may be about the same size or larger than the volume of the lighting unit.

Figure 5:
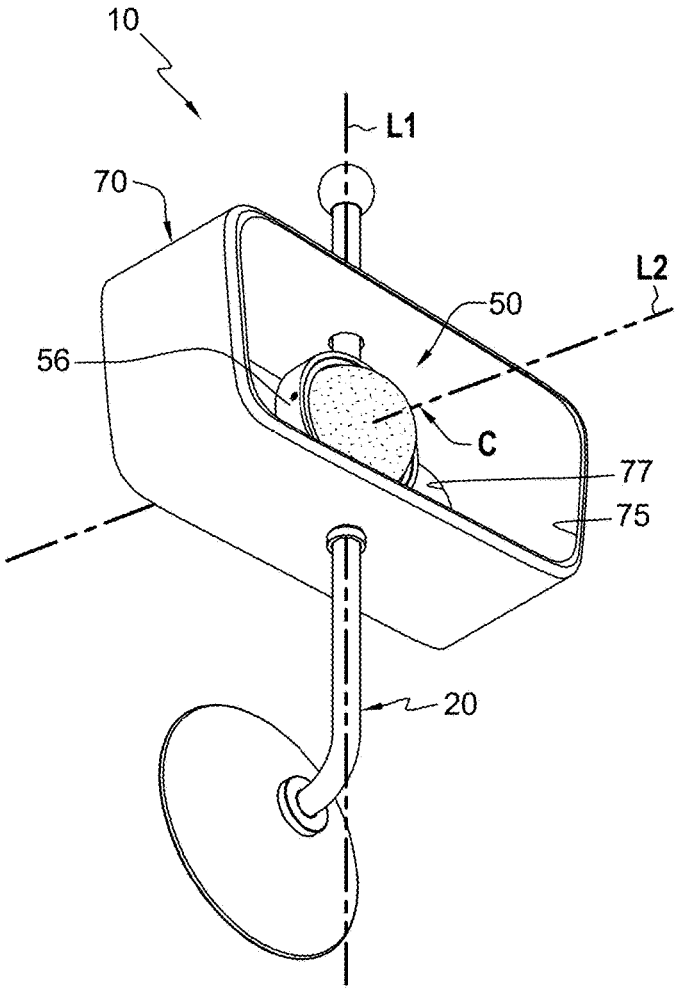
FIG. 5 is another perspective view of the lighting fixture of FIG. 1.

With reference to FIGS. 1, 2, and 5, surrounding member 70 is adjustably positionable about first axis L1. As best shown in FIG. 5, a center C of first front opening 75 of surrounding member 70 and a center (not shown in FIG. 5) of second rear opening 77 of surrounding member 70 may define a second axis L2 therethrough. Second axis L2 may be disposed along a second direction compared to the direction of L1. The second direction may be different from the first direction. For example, axes L1 and L2 may be disposed at a non-parallel angle relative to each other. In some embodiments, axis L2 may be perpendicular to or at a right angle to axis L1. For example, axis L1 may be a vertically disposed axis and axis L2 may be a horizontally disposed axis. It will be appreciated that the axis of the support member and the axis of the surrounding member may be disposed at other angles relative to each other. First front opening 75 of surrounding member 70 may define a planar opening, and second rear opening 77 of surrounding member 70 may define a planar opening. In some embodiments, one or both of the planar openings may be vertical planar openings.

Figure 4:
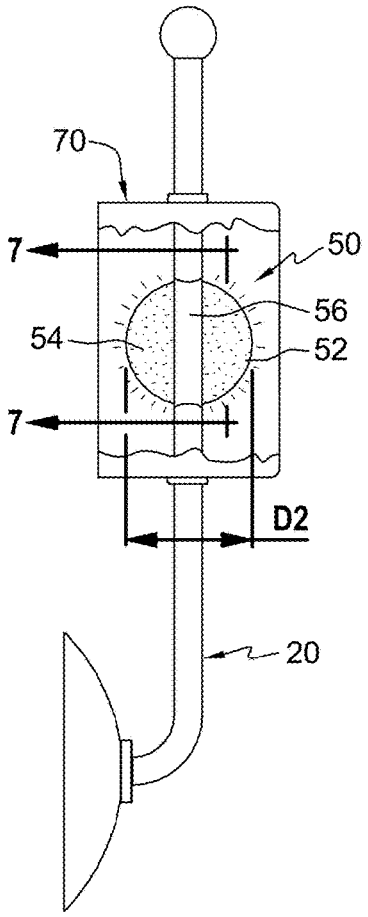
FIG. 4 is a side elevational view, portions cut away, of the lighting fixture of FIG. 1.

With reference to FIGS. 4 and 5, in this illustrated embodiment, lighting unit 50 may include a generally round or spherical lighting unit having a front diffusion member 52 having a curved outer surface and a rear diffusion member 54 (FIG. 4) having a curved outer surface. For example, the front and rear diffusion member may be generally convex spherical diffusion members, or generally hemispherical diffusion members. The diffusion members may be formed from a glass or polymeric material.

Lighting unit 50 may include a band 56 such as a circular opaque band. An upper portion and a lower portion of the band may be operably attached to support member 20. The lighting unit may have a width W2 (FIG. 3) less than the width W1 (FIG. 3) of surrounding member 70 (FIG. 3), a depth D2 (FIG. 4) less than the width D1 (FIG. 3) of surrounding member 70 (FIG. 3), and a height H2 (FIG. 3) less than the height H1 (FIG. 3) of surrounding member 70 (FIG. 3).

For example, lighting unit 50 may have a width W2 of about 1 inch, about 2 inches, about 3 inches, about 3.5 inches, about 5 inches, about 6 inches, about 8 inches, about 10 inches, about 12 inches, about 15 inches, about 20 inches, about 24 inches, about 25 inches or more, in the range between about 1 inch to about 25 inches, between about 2 inches to about 20 inches, between about 4 inches to about 12 inches, between about 5 inches to about 10 inches, between about 3.5 inches to about 8 inches, or other suitable width or range of widths; a height H2 of about 1 inch, about 2 inches, about 3 inches, about 3.5 inches, about 5 inches, about 6 inches, about 8 inches, about 10 inches, about 12 inches, about 15 inches, about 20 inches, about 24 inches, about 25 inches or more, in the range between about 1 inch to about 25 inches, between about 2 inches to about 20 inches, between about 4 inches to about 12 inches, between about 5 inches to about 10 inches, between about 3.5 inches to about 8 inches, or other suitable height of range of heights; and a depth D2 (FIG. 4) of about 1 inch, about 2 inches, about 3 inches, about 3.5 inches, about 5 inches, about 6 inches, about 8 inches, about 10 inches, about 12 inches, about 15 inches, about 20 inches, about 24 inches, about 25 inches or more, in the range between about 1 inch to about 25 inches, between about 2 inches to about 20 inches, between about 4 inches to about 12 inches, between about 5 inches to about 10 inches, between about 3.5 inches to about 8 inches, or other suitable depth. Other suitable sizes and configurations for the lighting unit may be employed.

Figure 6:
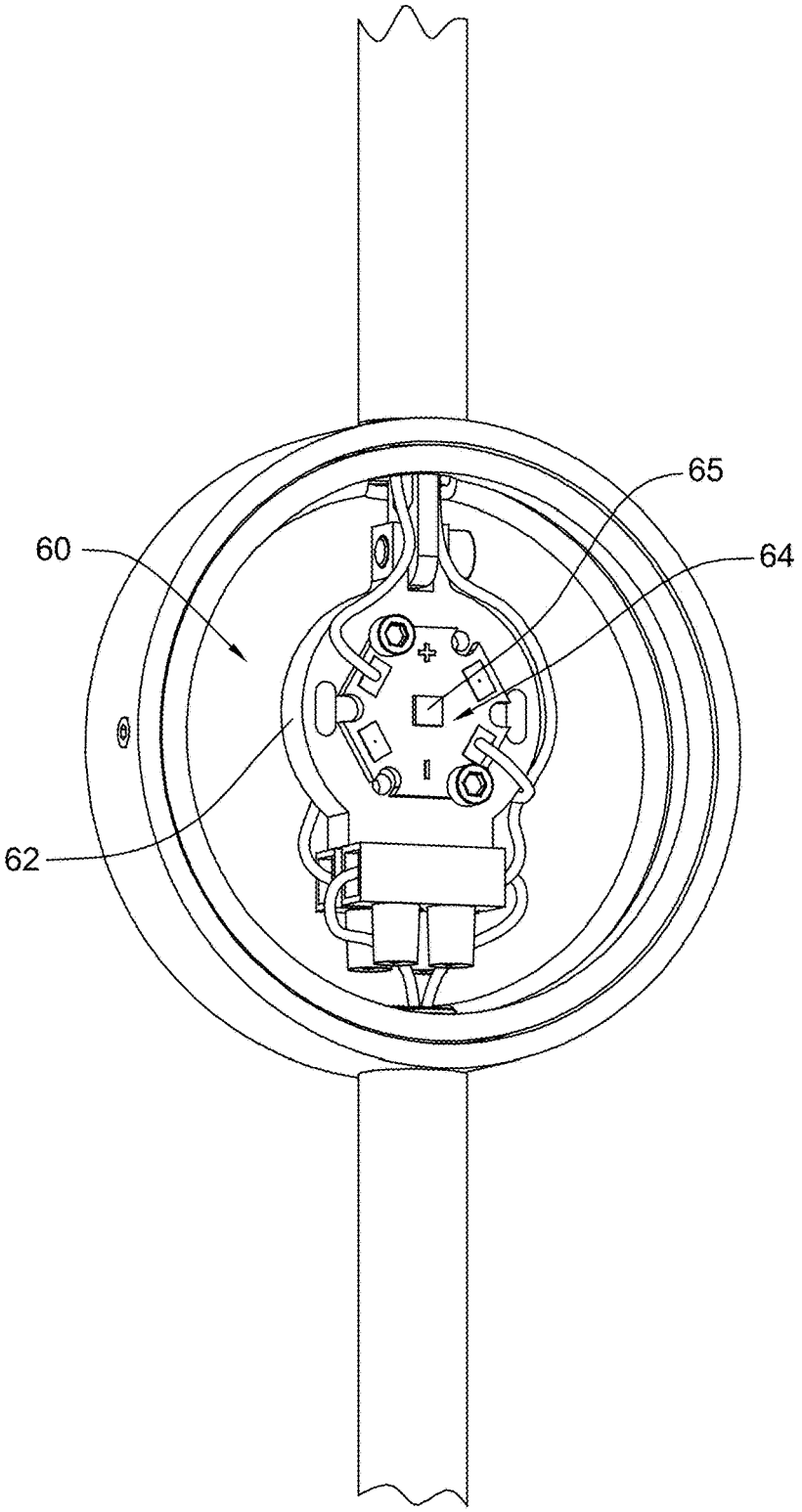
FIG. 6 is an enlarged perspective view of a portion of the lighting unit of the lighting fixture of FIG. 1 with the diffusion member removed.
Figure 7:
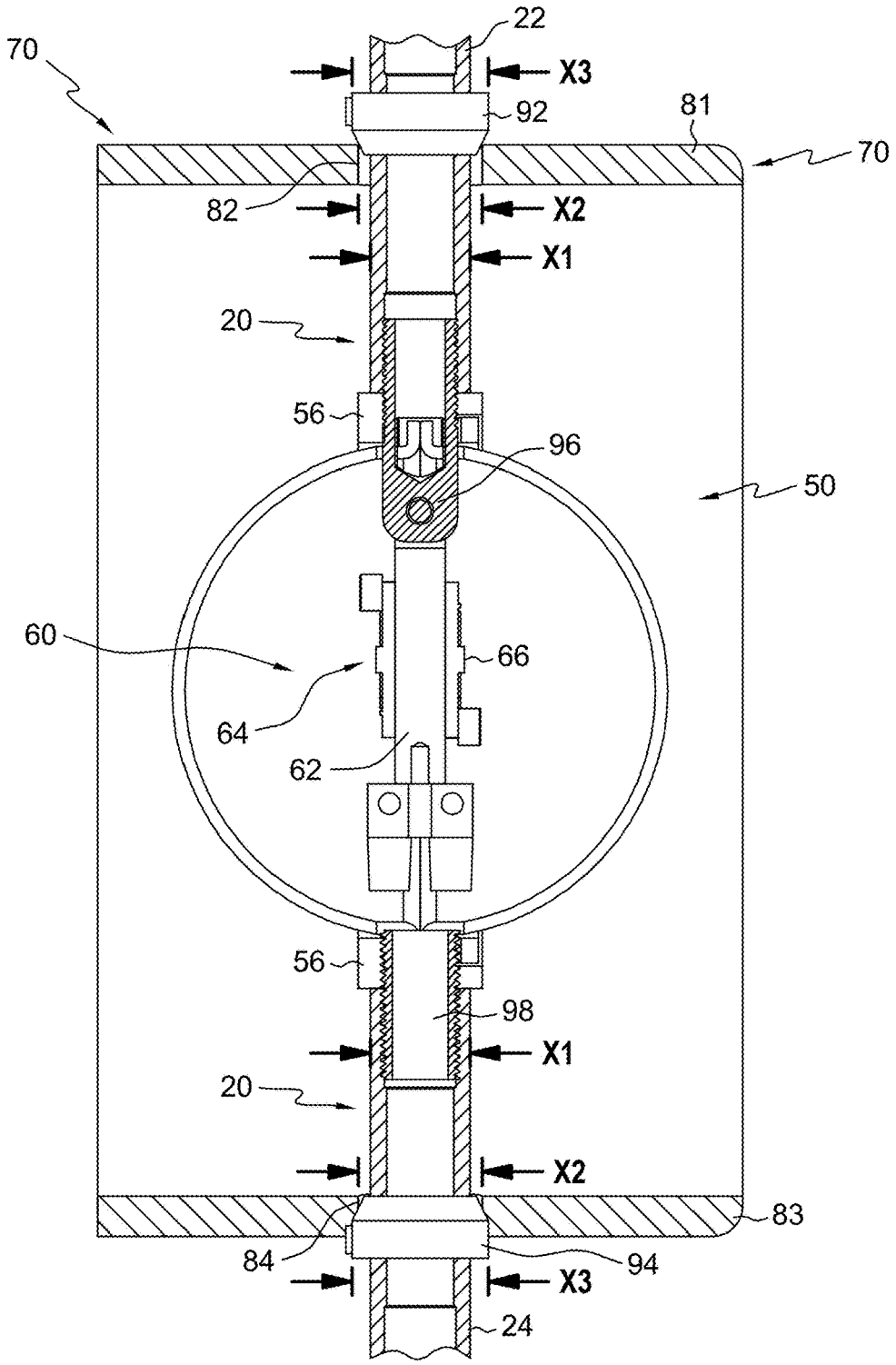
FIG. 7 is an enlarged cross-sectional view taken along lines 7-7 of the lighting unit of FIG. 4.

With reference to FIGS. 6 and 7, lighting unit 50 (FIG. 7) may include a light source 60 such as a front and back light source. For example, light source 60 may include a base 62 for supporting a front LED module 64 (FIG. 6) having a front LED 65 and a rear LED module (not shown). An electrical power supply (not shown) for converting AC current to DC current may be disposed in ceiling mount 30 or in an electrical box of the wall, and the electrical power supply connected to the LED module via wires or cables that extend through support member 20 for powering the light emitting diodes. LED modules may include an operable power supply. The light emitting diode may be an LED having a 2700-3000 k lumen light output or other suitable light output. It will be appreciated that other light sources may be suitably employed. For example, incandescent or florescent or other light sources, or combinations thereof may be employed.

As shown in FIG. 7, support member 20 may include upper portion 22 and lower portion 24. Upper portion 22 of support member 20 may extend through upper portion 81 of surrounding member 70, and lower portion 24 of support member 20 may extend through lower portion 83 of surrounding member 70. Upper portion 81 of surrounding member 70 may have an aperture 82 and lower portion 83 of surrounding member 70 may have an aperture 84. An upper collar 92 may be operably attached to upper support member 22, and a lower collar 94 may be operably attached to lower support member 24. For example, upper and lower portions of support member 20 may have an outer diameter X1, upper aperture 82 and lower aperture 84 of surrounding member 70 may have a diameter X2 sized larger that the outer diameter of support member 20, and an outside diameter X3 of upper collar 92 and lower collar 94 may be sized larger than the diameter of the upper aperture and the lower aperture of surrounding member 70.

An externally threaded hollow upper member 96 may be operably attached to an internally threaded portion of upper portion 22 of support member 20. An externally threaded hollow lower member 98 may be operably attached to an internally threaded portion of lower portion 24 of support member 20. Ends of member 96 and 98 may also operably attach to band 56 of lighting unit 50.

Figure 8:
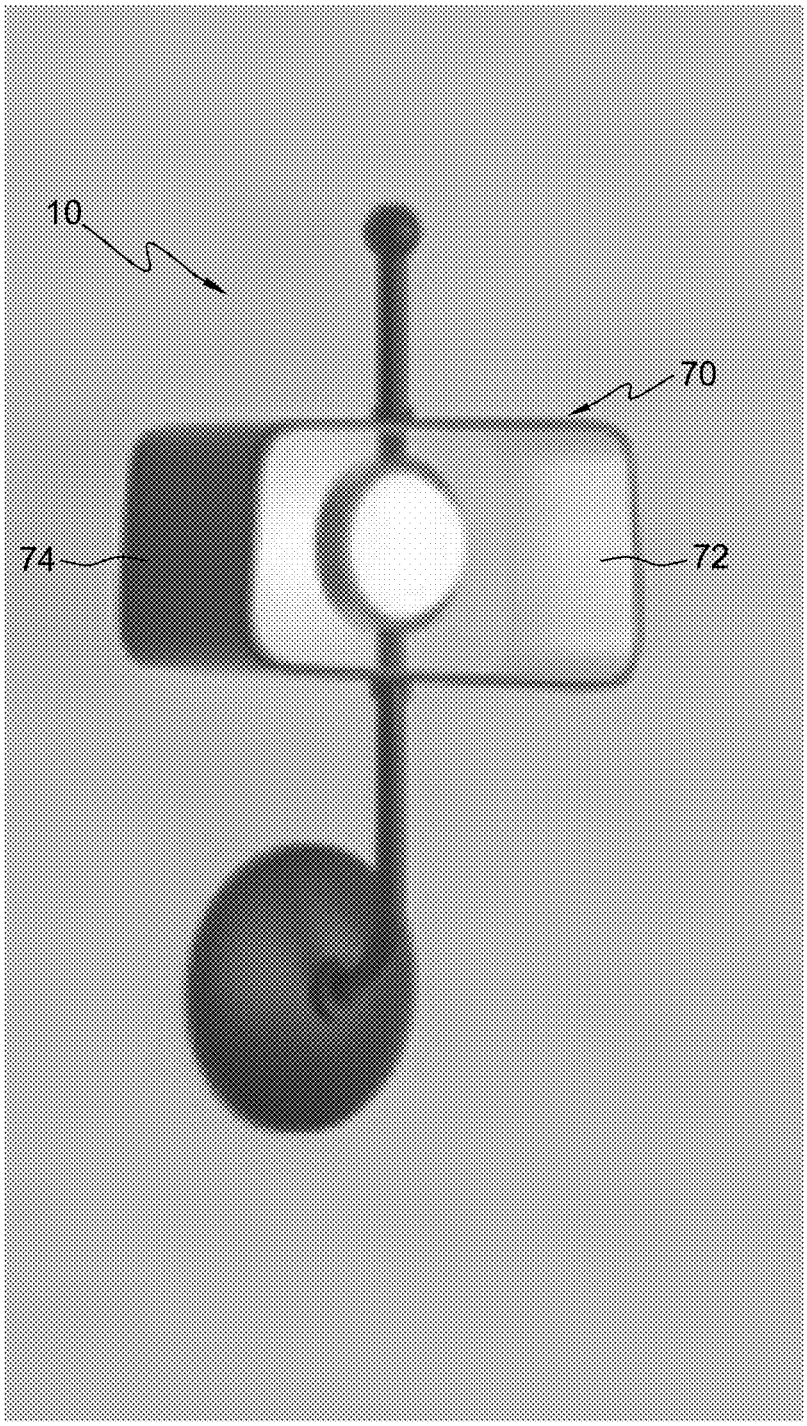
FIG. 8 is another perspective view of the lighting fixture of FIG. 1 illustrated with illumination.

FIG. 8 illustrates lighting fixture 10 with illumination, e.g., with the lighting unit on so that the diffusion members are illuminated (only the front diffusion member being shown in FIG. 8 and with illumination being emitted rearward being shown in FIG. 8). In this illustrated embodiment, inner surface 72 of surrounding member 70 may be a first color, and outer surface 74 of surrounding member 70 may be a second color different from the first color. For example, the outer exterior surface of the surrounding member may be black, and the inner interior surface of the surrounding member may be gold such as reflective gold leaf.

Figure 9:
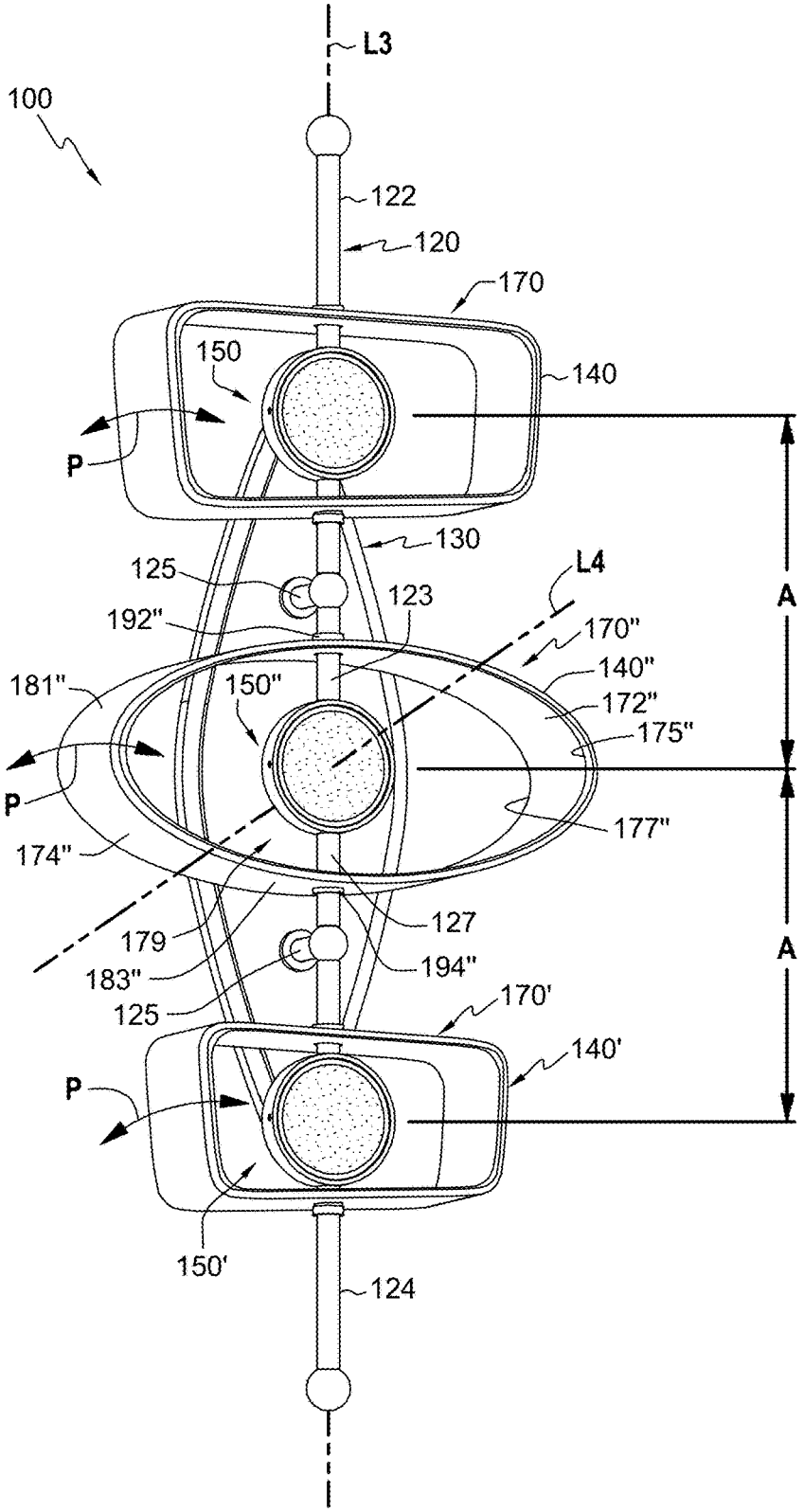
FIG. 9 is a perspective view of a lighting fixture according to an embodiment of the present disclosure.

FIG. 9 illustrates a lighting fixture 100 such as a wall sconce according to an embodiment of the present disclosure. In this illustrated embodiment, lighting fixture 100 may generally include a support member 120, a wall mount 130, and a plurality of lighting elements 140, 140', and 140". Wall mount 130 may allow operably attaching the lighting fixture to a wall. The lighting fixture may also be operably connectable to electrical power in a home or other building. For example, electrical power may typically be provided to the lighting fixture by electrical wires or cables such as conventional 120 or 240 volt AC power from the local electrical grid. Alternatively, electrical power may be provided by one or more batteries.

As shown in FIG. 9, a portion or component of a lighting elements 140, 140", and 140" of lighting fixture 100 may be movable or rotatable in the direction of curved arrows P and positionable over a range of positions so that the lighting fixture is operable to have a plurality of different configurations.

Elongated support member 120 may include a first end portion 122 and a second end portion 124 such as an upper end portion and a lower end portion. Support 120 may be generally straight defining a generally longitudinal straight axis L3. For example, in this illustrated embodiment, the support may include a vertically disposed elongated support straight portion defining a longitudinal axis disposed along a first direction such as a vertical direction. One or more brackets 125 may be operably connected to support 120 to wall mount 130 so that lighting fixture 100 may be disposed vertically from the wall. In other embodiments, lighting fixture 150 may be attached and supported from a wall in which support member 120 is disposed horizontally or at a not vertical or horizontal angle.

Lighting element 140 generally includes a lighting unit 150 and a surrounding member 170. Lighting element 140' generally includes a lighting unit 150' and a surrounding member 170'. Lighting units 150 and 150' may be the same size, and surrounding member 170 may be sized larger than surrounding member 170'. Lighting elements 140 and 140' may be essentially the same as lighting element 40 (FIGS. 1-7).

With reference to lighting element 140", surrounding member 170" may be a generally symmetric oval surrounding member having an inner surface 172" and an outer surface 174" defining a first opening 175" and a second opening 177". Inner surface 172" defines a cavity 179" therein between first opening 175", inner surface 172", and second opening 177". In this illustrated embodiment, the surrounding member is a continuous surrounding member that extends continuously around lighting unit 150". The surrounding member may have a width about 5 inches, about 6 inches, about 9 inches, about 10 inches, about 12 inches, about 15 inches, about 20 inches, about 24 inches, about 25 inches or more, in the range between about 5 inches to about 25 inches, between about 9 inches to about 25 inches, between about 6 inches to about 20 inches, or other suitable width, a height H1 of about 2 inches, about 4 inches, about 5 inches, about 6 inches, about 10 inches, about 12 inches, about 15 inches, about 20 inches, about 24 inches, about 25 inches or more, in the range between about 2 inches to about 25 inches, between about 6 inches to about 20 inches, between about 4 inches to about 12 inches, or other suitable height, and a depth D1 of about 1 inch, about 2 inches, about 3 inches, about 5 inches, about 6 inches, about 10 inches, about 12 inches, about 15 inches, about 20 inches, about 24 inches or more, in the range between about 1 inch to about 24 inches, between about 2 inches to about 15 inches, between about 3 inches to about 12 inches, between about 4 inches to about 10 inches, or other suitable depth.

As illustrated, surrounding member 170" may have an oval cross-section. For example, surrounding member 170" may have a generally curved upper portion 181", a generally curved lower portion 183". Surrounding member 170" may be a continuous surrounding member, may be a thin flat surrounding member, and may be opaque. about 0.1 inch, about 0.125 inch, about 0.2 inch, about 0.25 inch, about 0.375 inch, about 0.5 inch, about 0.75 inch, about 1 inch, about 2 inches or more inches, in a range between about 0.1 inch to about 2 inches, in a range between about 0.1 inch to about 1 inch, in a range between about 0.1 inch to about 0.5 inches, in a range between about 0.2 inch to about 0.5 inches, or other suitable thickness. The thickness may be constant of the surrounding member may be constant. In some embodiments, the thickness of the surrounding member may vary.

Elongated support 120 may extend through a first portion such as upper portion 181" of surrounding member 170" between first opening 175" and second opening 177", and may extend through a second portion such lower portion 183" of surrounding member 170" between first opening 175" and second opening 177".

Lighting unit 150" is operably connected to elongated support 120 between first end portion 122 and second end portion 124, and disposed in cavity 179" and spaced from inner surface 172" of surrounding member 170".

As described above, surrounding member 170" is adjustably positionable about first axis L3. As shown in FIG. 9, surrounding member 170" may define a second axis L4 disposed along a second direction extending through first opening 175" and second opening 177". The first direction may be different from the second direction. For example, axes L3 and L4 may be disposed perpendicular or at a right angle to each other. Axis L3 may be a vertically disposed axis and axis L4 may be a horizontally disposed axis. It will be appreciated that the axis of the support member and the axis of the surrounding member may be disposed at other angles relative to each other.

In this illustrated embodiment, lighting unit 150" may be essentially the same as lighting unit 150 (FIGS. 1-7). Lighting unit 150" may have a width less than the width of surrounding member 170", a depth less than the width of surrounding member 170", and a height less than the height of surrounding member 170". For example, lighting unit 150" may have a width W2 of about 1 inch, about 2 inches, about 3 inches, about 3.5 inches, about 5 inches, about 6 inches, about 8 inches, about 10 inches, about 12 inches, about 15 inches, about 20 inches, about 24 inches, about 25 inches or more, in the range between about 1 inch to about 25 inches, between about 2 inches to about 20 inches, between about 4 inches to about 12 inches, between about 5 inches to about 10 inches, between about 3.5 inches to about 8 inches, or other suitable width or range of widths; a height of about 1 inch, about 2 inches, about 3 inches, about 3.5 inches, about 5 inches, about 6 inches, about 8 inches, about 10 inches, about 12 inches, about 15 inches, about 20 inches, about 24 inches, about 25 inches or more, in the range between about 1 inch to about 25 inches, between about 2 inches to about 20 inches, between about 4 inches to about 12 inches, between about 5 inches to about 10 inches, between about 3.5 inches to about 8 inches, or other suitable height of range of heights; and a depth of about 1 inch, about 2 inches, about 3 inches, about 3.5 inches, about 5 inches, about 6 inches, about 8 inches, about 10 inches, about 12 inches, about 15 inches, about 20 inches, about 24 inches, about 25 inches or more, in the range between about 1 inch to about 25 inches, between about 2 inches to about 20 inches, between about 4 inches to about 12 inches, between about 5 inches to about 10 inches, between about 3.5 inches to about 8 inches, or other suitable depth. Other suitable sizes and configurations for the lighting unit may be employed.

Lighting unit 150" and the LED module therein may be operably connected to an electrical power supply via wires or cables that extend through support 120. An electrical power supply (not shown) for converting AC current to DC current may be disposed in wall mount 130 or in an electrical box of the wall, and the electrical power supply may be connected to the LED module in the lighting unit via wires or cables that extend through support member 120 for powering the light emitting diodes. Lighting units 150, 150', and 150" may be operably serially connected via wires to the electrical power supply (not shown) in wall mount 130.

Support member 120 may include middle upper portion 123 and middle lower portion 127. Middle upper portion 123 of support member 120 may extend through upper portion 181" of surrounding member 170", and middle lower portion 127 of support member 120 may extend through lower portion 183" of surrounding member 170". Upper portion 181" of surrounding member 170" may have an aperture and lower portion 183" of surrounding member 170" may have an aperture. An upper collar 192" may be operably attached to middle upper support member 123, and a lower collar 194" may be operably attached to lower support member 127. For example, middle upper and middle lower portions of support member 120 may have an outer diameter, the upper aperture and lower aperture of surrounding member 170" may have a diameter sized larger that the outer diameter of support member 120, and an outside diameter of upper collar 192" and lower collar 194" may be sized larger than the diameter of the upper aperture and the lower aperture of surrounding member 170".

Lighting units 140, 140", and 140" may be equally spaced apart about a distance A of about 2 inches, 4 inches, 6 inches, about 8 inches, about 10 inches, about 12 inches, between the range of 2 inches to 12 inches, between the range of 2 inches to 8 inches, between the range of 4 inches to 12 inches, between the range of 6 inches to 10 inches, or other suitable distance.

Figure 10:
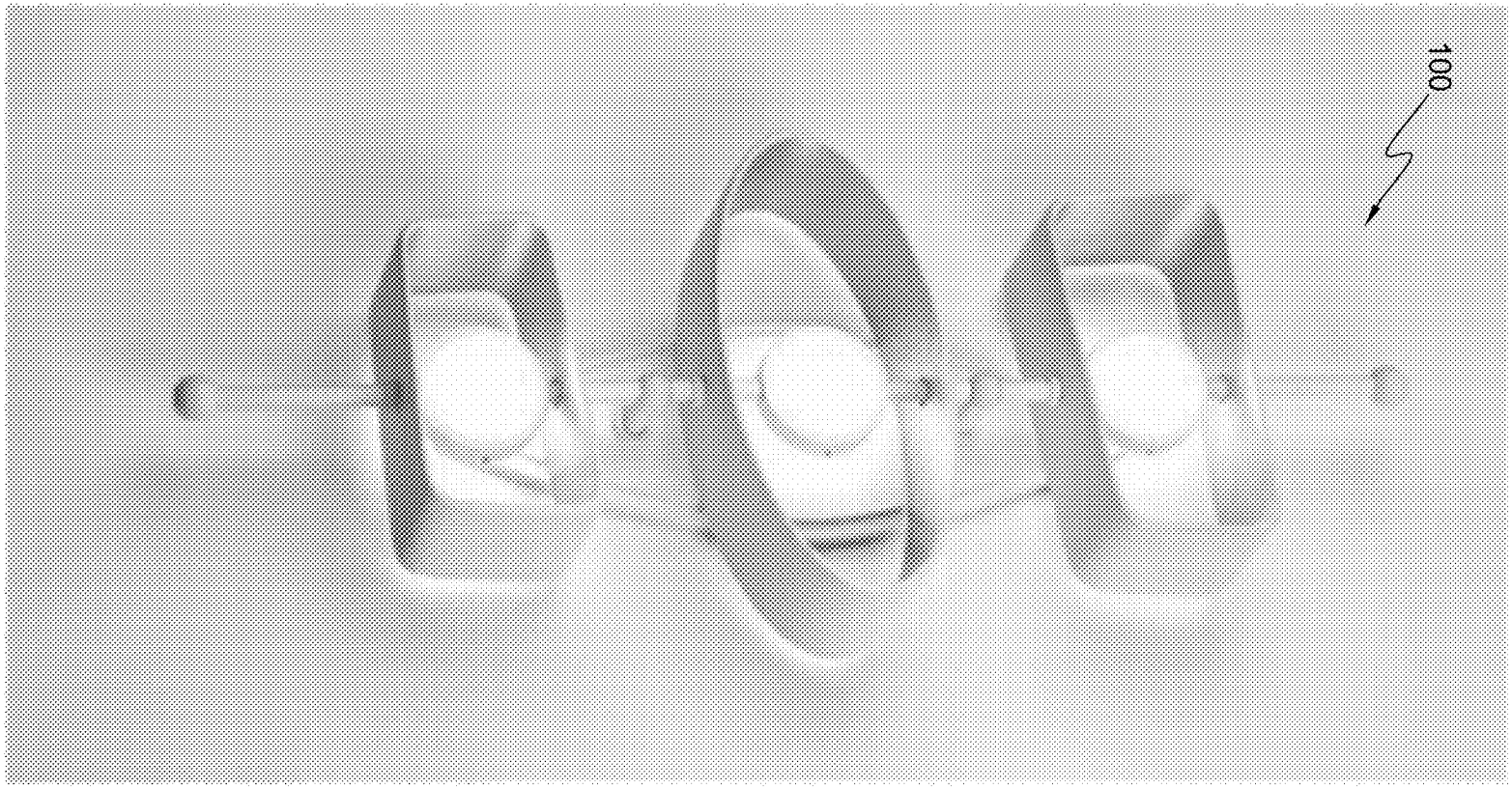
FIG. 10 is another perspective view of the lighting fixture of FIG. 9 illustrated with illumination.

FIG. 10 illustrates lighting fixture 100 with illumination, e.g., with the lighting unit on so that the diffusion members are illuminated (only the front facing diffusion members being shown in FIG. 10 and with illumination being emitted rearward being shown in FIG. 8). In this illustrated embodiment, the inner surfaces of the surrounding members may be a first color, and the outer surfaces of the surrounding members may be a second color different from the first color. For example, the outer exterior surfaces of the surrounding members may be white, and the inner interior surfaces of the surrounding members may be gold such as reflective gold leaf.

Figure 11:
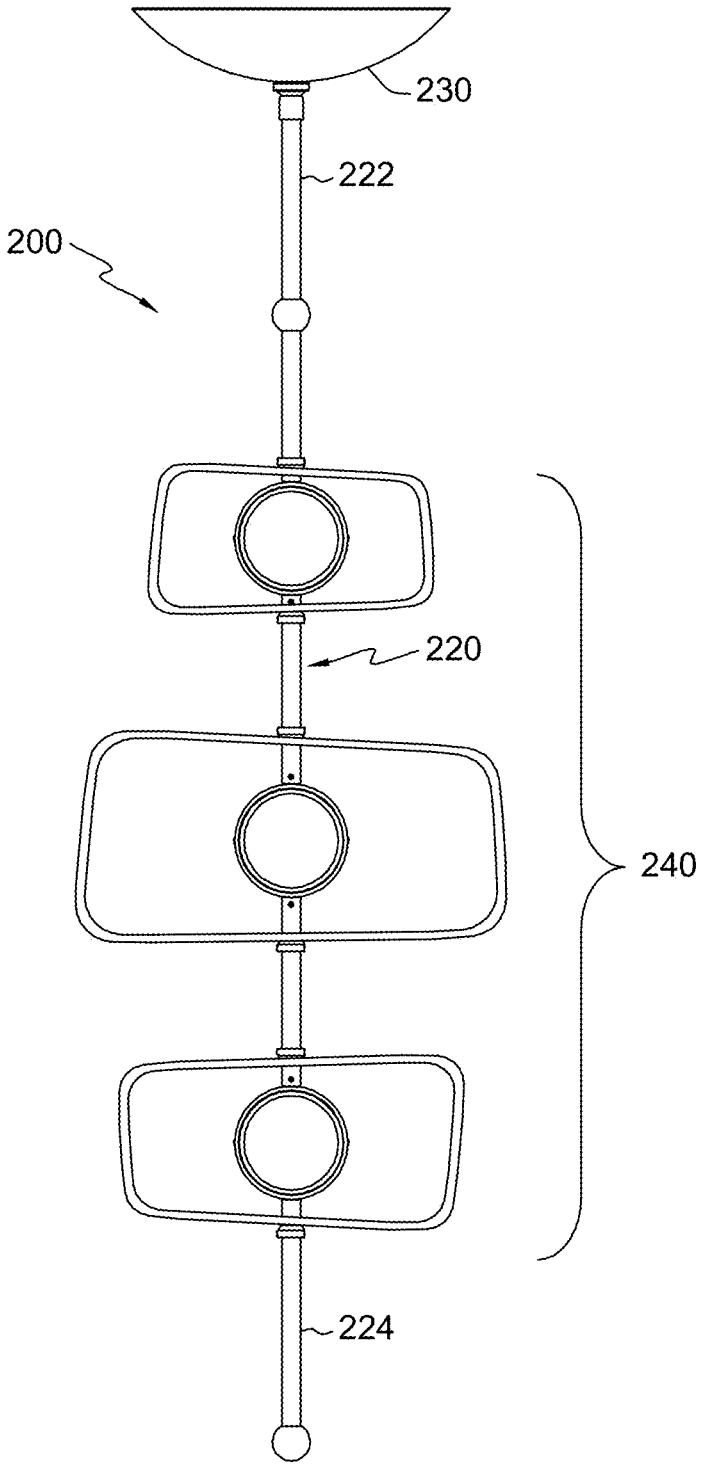
FIG. 11 is a front elevational view of a lighting fixture according to an embodiment of the present disclosure.

FIG. 11 illustrates a lighting fixture 200 such as a hanging pendant lighting fixture according to an embodiment of the present disclosure. In this illustrated embodiment, lighting fixture 200 may generally include a support member 220, a ceiling mount 230, and a plurality of lighting elements 240. For example, lighting fixture 200 may have three lighting elements. Wall mount 230 may allow operably attaching the lighting fixture to a ceiling. The lighting fixture may also be operably connectable to electrical power in a home or other building. For example, electrical power may typically be provided to the lighting fixture by electrical wires or cables such as conventional 120 or 240 volt AC power from the local electrical grid. Alternatively, electrical power may be provided by one or more batteries.

Elongated support 220 may include a first end portion 222 and a second end portion 224 such as an upper end portion and a lower end portion. Support 220 may be generally straight defining a generally longitudinal straight axis. For example, in this illustrated embodiment, the support may include a vertically disposed elongated support straight portion defining a longitudinal axis disposed along a first direction such as a vertical direction. First upper end portion 222 may be operably connected to support 220 to ceiling mount 230 and so that lighting fixture 200 may be disposed vertically from the ceiling.

Each of lighting elements 240 may generally include a lighting unit and a surrounding member, which may be essentially the same as lighting unit 50 (FIGS. 1-7) and surrounding member 70 (FIGS. 1-7) described above. The three surrounding members shown in FIG. 11 may have different sizes and configurations. A portion or component such as one or more of the surrounding members of the lighting elements 240 of lighting fixture 200 may be movable or rotatable and positionable over a range of positions so that the lighting fixture is operable to have a plurality of different configurations. The three surrounding members may have a rectangular, or generally irregular rectangular or trapezoidal cross-section with the opposite side not being parallel.

The lighting units may be operably connected to an electrical power supply via wires or cables that extend through support 220. An electrical power supply (not shown) for converting AC current to DC current may be disposed in wall mount 230 or in an electrical box, and the electrical power supply may be connected to LED modules in the lighting units via wires or cables that extend through support 220 for powering the light emitting diodes. The lighting units may be operably serially connected to the electrical power supply (not shown) in wall mount 230 or in the electrical box.

The length of support member 220 of lighting fixture 200 may be about 36 inches, about 48 inches, about 56 inches, about 76 inches, about 94 inches, between a range of about 36 inches to about 94 inches, between a range of about 48 inches to about 76 inches, or other suitable length.

Figure 12:
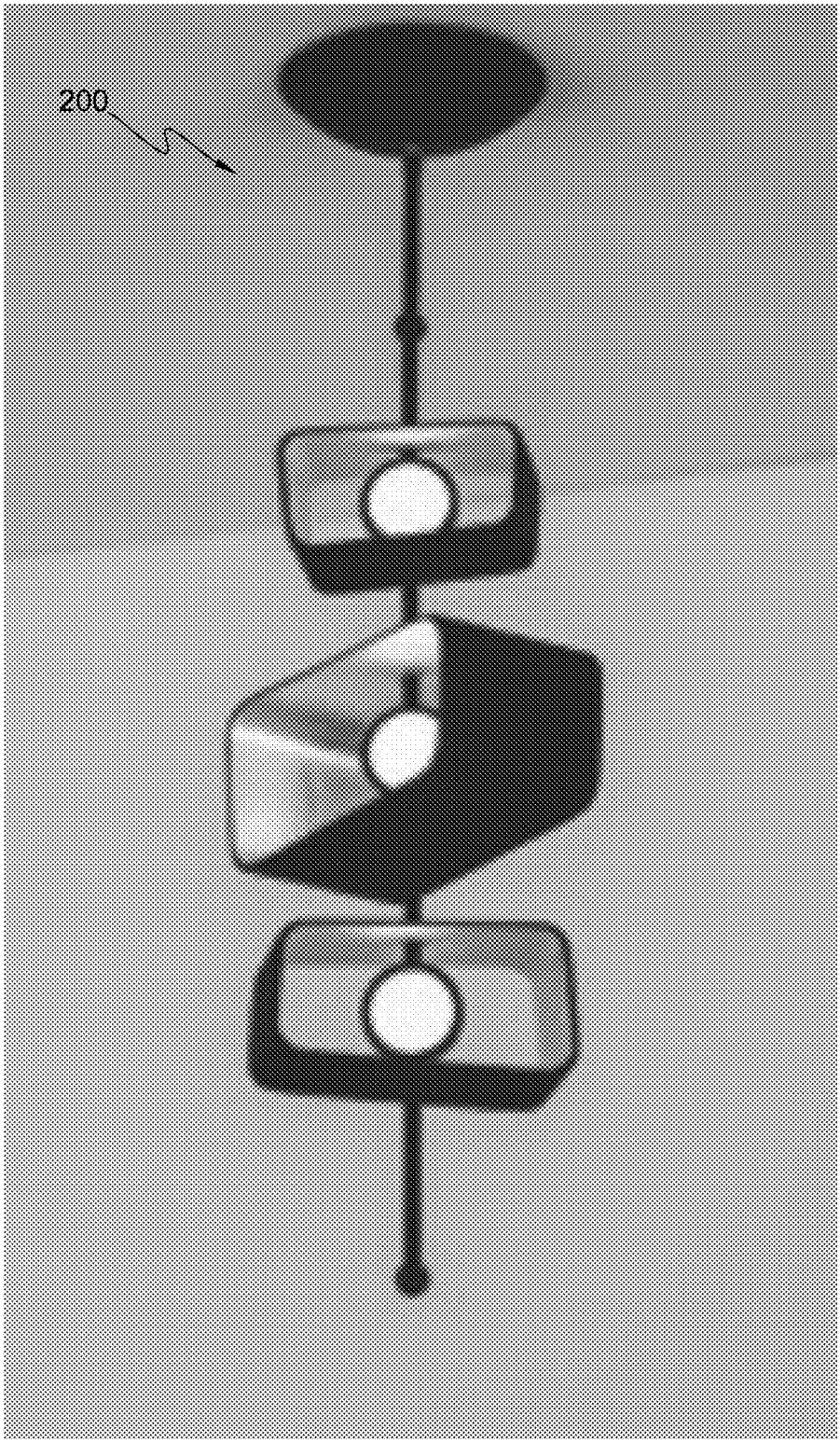
FIG. 12 is a perspective view of the lighting fixture of FIG. 11 illustrated with illumination.

FIG. 12 illustrates lighting fixture 200 with illumination, e.g., with the lighting unit on so that the diffusion members are illuminated (only the front facing diffusion members being shown in FIG. 12). In this illustrated embodiment, inner surfaces of the surrounding members may be a first color, and outer surfaces of surrounding members may be a second color different from the first color. For example, the outer exterior surfaces of the surrounding members may be black, and the inner interior surfaces of the surrounding member may be gold such as reflective gold leaf.

Figure 13:
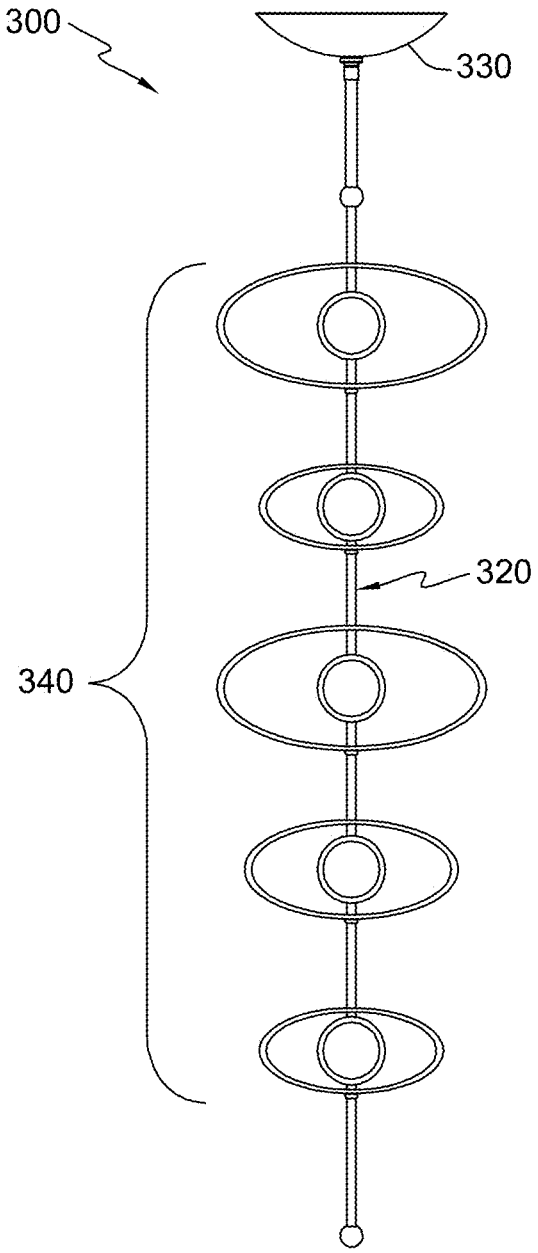
FIG. 13 is a front elevational view of a lighting fixture according to an embodiment of the present disclosure.

FIG. 13 illustrates a lighting fixture 300 such as a hanging pendant lighting fixture according to an embodiment of the present disclosure. In this illustrated embodiment, lighting fixture 300 may generally include a support member 320, a ceiling mount 330, and a plurality of lighting elements 340 such as oval lighting elements. For example, lighting fixture 300 may have five lighting elements. Wall mount 330 may allow operably attaching the lighting fixture to a ceiling as described above.

Each of lighting element 340 may generally include a lighting unit and a surrounding member, which may be essentially the same as the lighting units and surrounding members described above. The five surrounding members shown in FIG. 13 may include three different sizes and configurations. A portion or component such as one or more of the surrounding members of the lighting elements 340 of lighting fixture 300 may be movable or rotatable and positionable over a range of positions so that the lighting fixture is operable to have a plurality of different configurations. The surrounding members may have an oval cross-section with vertically disposed planar openings. The lighting units may be operably connected to an electrical power supply as described above.

The length of support member 320 of lighting fixture 300 may be about 48 inches, about 56 inches, about 76 inches, about 94 inches, about 112 inches, between a range of 48 inches to about 112 inches, between a range of about 56 inches to 94 inches, or other suitable length.

Figure 14:
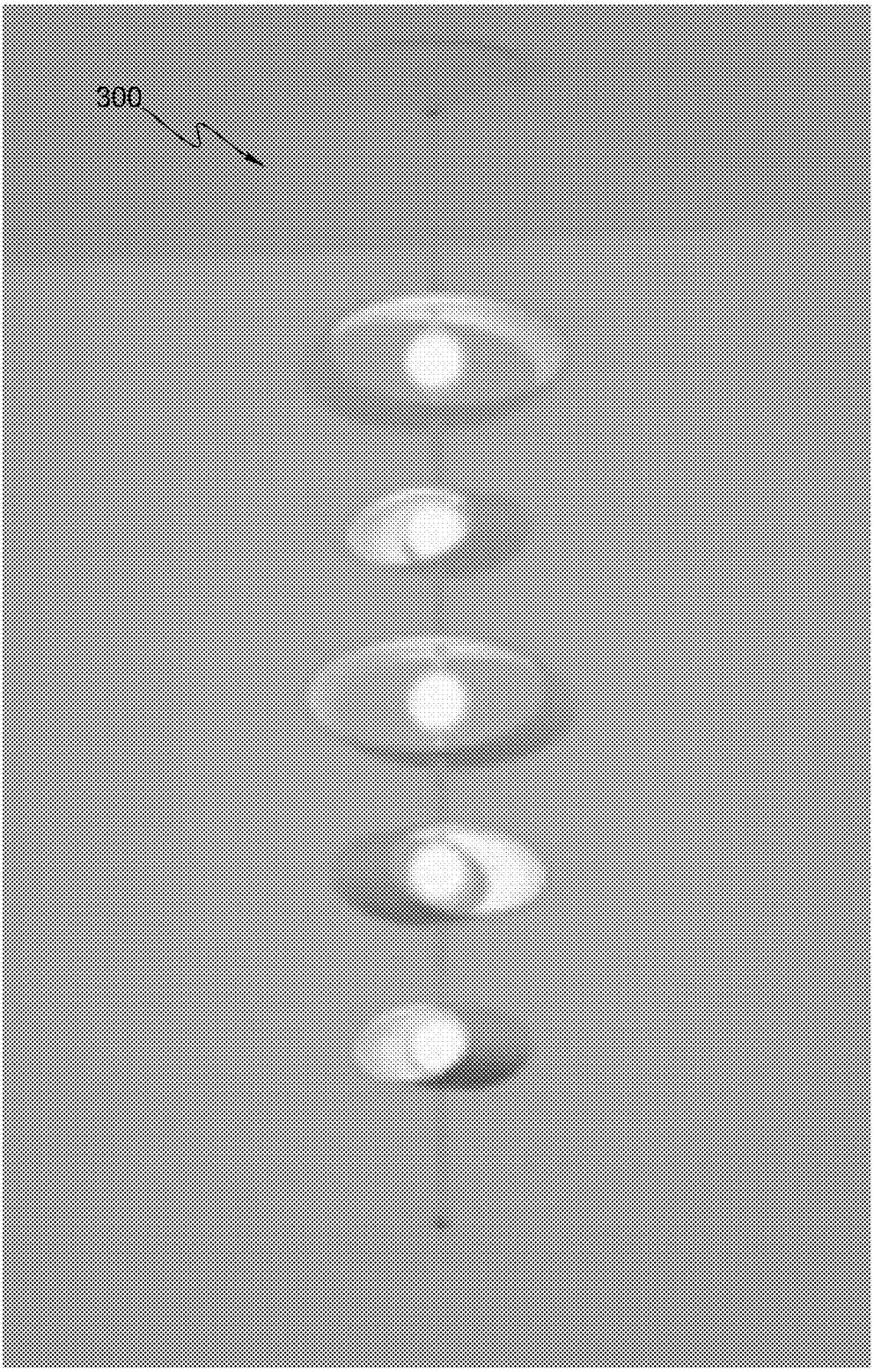
FIG. 14 is a perspective view of the lighting fixture of FIG. 13 illustrated with illumination.

FIG. 14 illustrates lighting fixture 300 with illumination, e.g., with the lighting unit on so that the diffusion members are illuminated (only the front facing diffusion members being shown in FIG. 14). In this illustrated embodiment, inner surfaces and the outer surfaces of the surrounding members may have the same color. For example, the outer exterior surfaces of the surrounding members may be white, and the inner interior surfaces of the surrounding members may be white.

Figure 15:
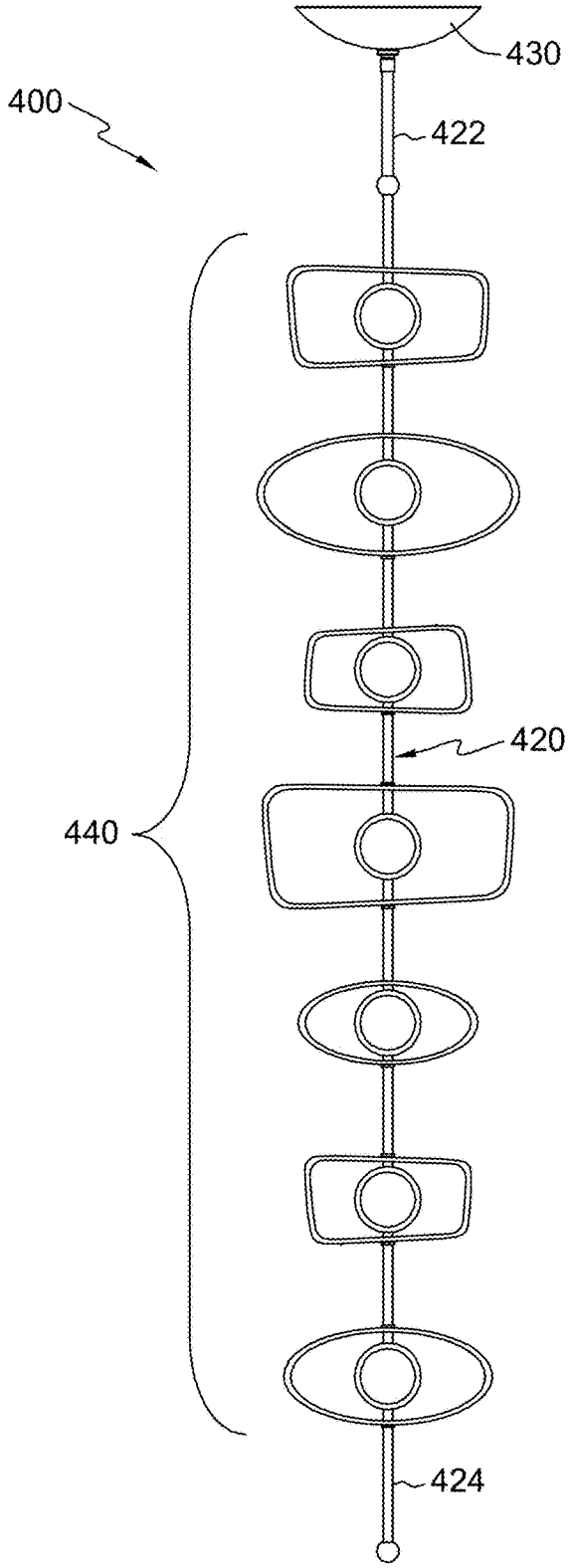
FIG. 15 is a front elevational view of a lighting fixture according to an embodiment of the present disclosure.

FIG. 15 illustrates a lighting fixture 400 such as a hanging pendant lighting fixture according to an embodiment of the present disclosure. In this illustrated embodiment, lighting fixture 400 may generally include a support member 420, a ceiling mount 430, and a plurality of lighting elements 440. For example, lighting fixture 400 may have seven lighting elements. Wall mount 430 may allow operably attaching the lighting fixture to a ceiling as described above.

Each of lighting element 440 may generally include a lighting unit and a surrounding member, which may be essentially the same as the lighting units and surrounding members described above. Each of the seven surrounding members shown in FIG. 15 may have a different configuration and/or size, and may include seven different surrounding members. A portion or component such as one or more of the surrounding members of the lighting elements 440 of lighting fixture 400 may be movable or rotatable and positionable over a range of positions so that the lighting fixture is operable to have a plurality of different configurations. The surrounding members may have a rectangular, trapezoidal, or generally irregular rectangular or trapezoidal cross-section with the opposite side not being parallel and vertically disposed planar openings, or an oval cross-section with vertically disposed planar openings. The lighting units may be operably connected to an electrical power supply as described above.

Figure 16:
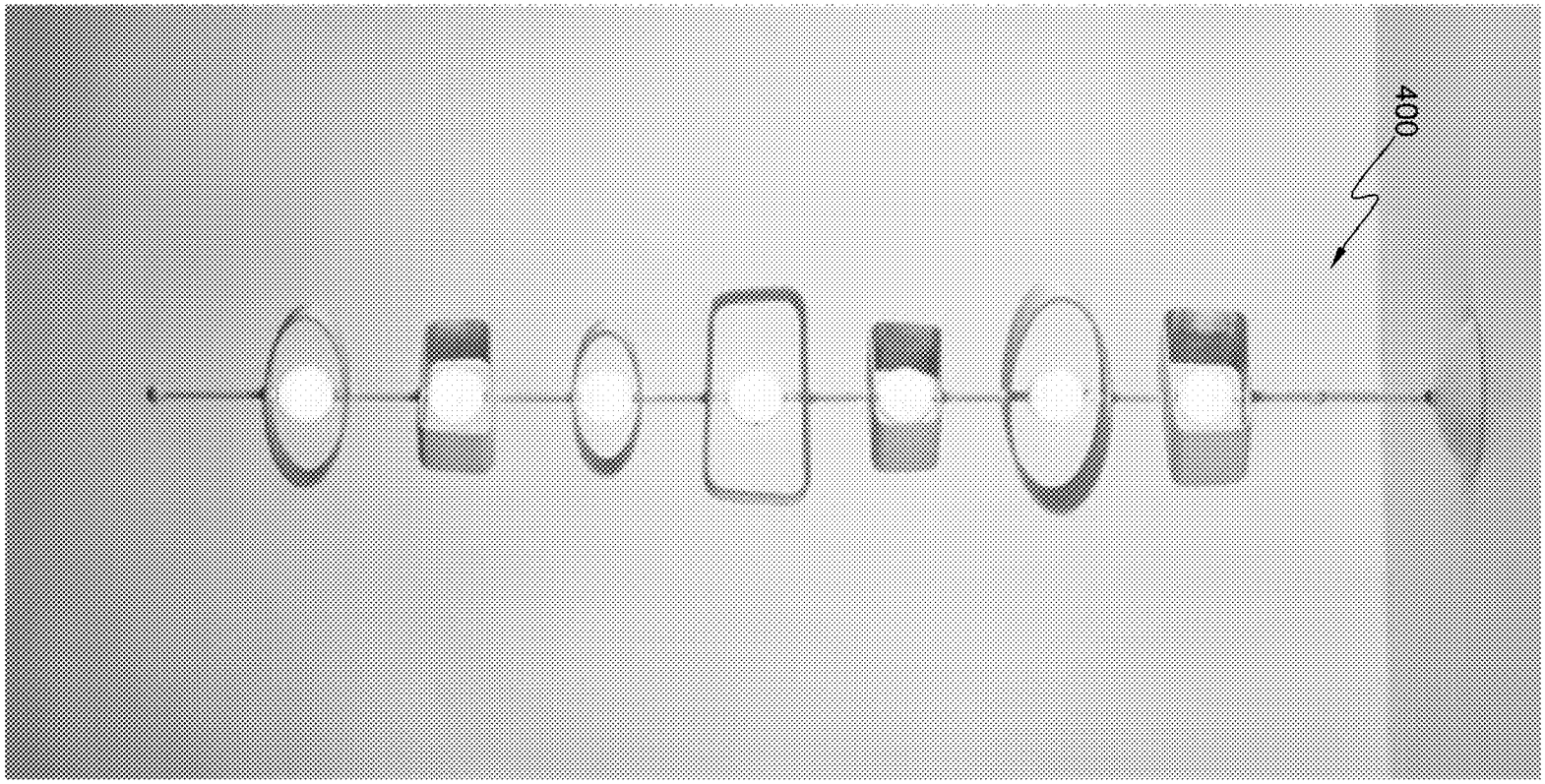
FIG. 16 is a perspective view of the lighting fixture of FIG. 15 illustrated with illumination.

FIG. 16 illustrates lighting fixture 400 with illumination, e.g., with the lighting unit on so that the diffusion members are illuminated (only the front facing diffusion members being shown in FIG. 16). In this illustrated embodiment, inner surfaces of the surrounding members may be a first color, and outer surfaces of surrounding members may be a second color different from the first color. For example, the outer exterior surfaces of the surrounding members may be white, and the inner interior surfaces of the surrounding member may be gold such as reflective gold leaf.

The length of support member 420 of lighting fixture 400 may be about 56 inches, about 76 inches, about 94 inches, about 112 inches, about 130 inches, between a range of 56 inches to about 130 inches, between a range of about 76 inches to 112 inches, or other suitable length. Lighting elements 440 may be essentially the same as described above.

Figure 17:
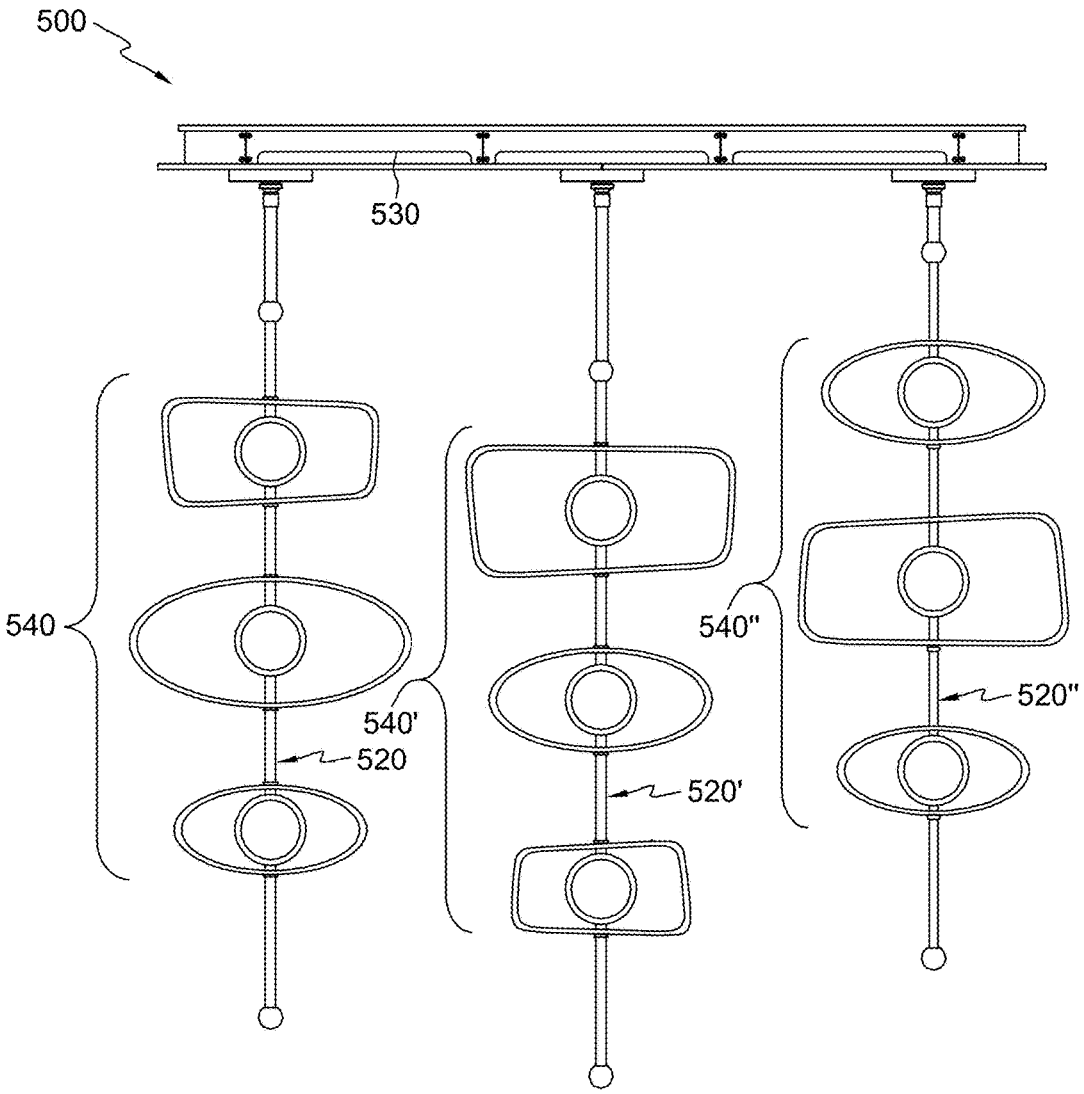
FIG. 17 is a front elevational view of a lighting fixture according to an embodiment of the present disclosure.

FIG. 17 illustrates a lighting fixture 500 such as a series of hanging pendant lighting fixtures according to an embodiment of the present disclosure. In this illustrated embodiment, lighting fixture 500 may generally include a support members 520, 520', and 520", a ceiling mount 530, and a series of a plurality of lighting elements 540, 540' and 540". For example, lighting fixture 500 may have three sets of hanging pendant lighting elements. Wall mount 530 may allow operably attaching the lighting fixture to a ceiling in a similar manner as described above.

Each of lighting elements may generally include a lighting unit and a surrounding member, which may be essentially the same as the lighting units and surrounding members described above. Each of the surrounding members shown in FIG. 17 may have a different configuration and/or size. A portion or component such as one or more of the surrounding members of the lighting elements of lighting fixture 500 may be movable or rotatable and positionable over a range of positions so that the lighting fixture is operable to have a plurality of different configurations. The surrounding members may have a rectangular, trapezoidal, or generally irregular rectangular or trapezoidal cross-section with the opposite side not being parallel and vertically disposed planar openings, or an oval cross-section with vertically disposed planar openings. The lighting units may be operably connected to an electrical power supply in a similar manner as described above.

Figure 18:
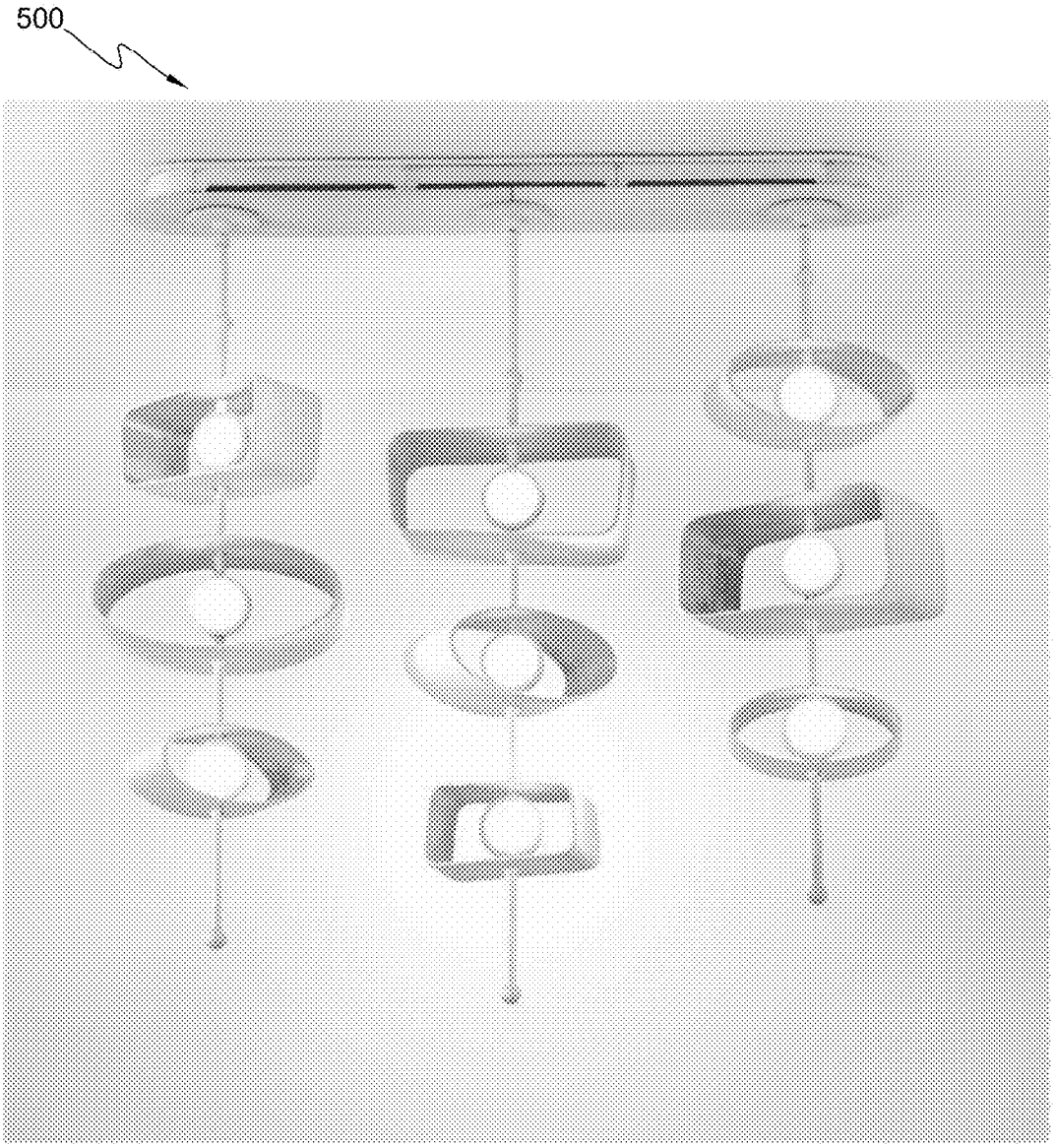
FIG. 18 is a perspective view of the lighting fixture of FIG. 17 illustrated with illumination.

FIG. 18 illustrates lighting fixture 500 with illumination, e.g., with the lighting unit on so that the diffusion members are illuminated (only the front facing diffusion members being shown in FIG. 18). In this illustrated embodiment, inner surfaces of the surrounding members may be a first color, and outer surfaces of surrounding members may be a second color different from the first color. For example, the outer exterior surfaces of the surrounding members may be white, and the inner interior surfaces of the surrounding member may be gold such as reflective gold leaf.

The length of support members 520, 520', and 520" of lighting fixture 500 may be about 36 inches, about 48 inches, about 56 inches, about 76 inches, about 94 inches, between a range of about 36 inches to about 94 inches, between a range of about 48 inches to about 76 inches, or other suitable length.

Figure 19:
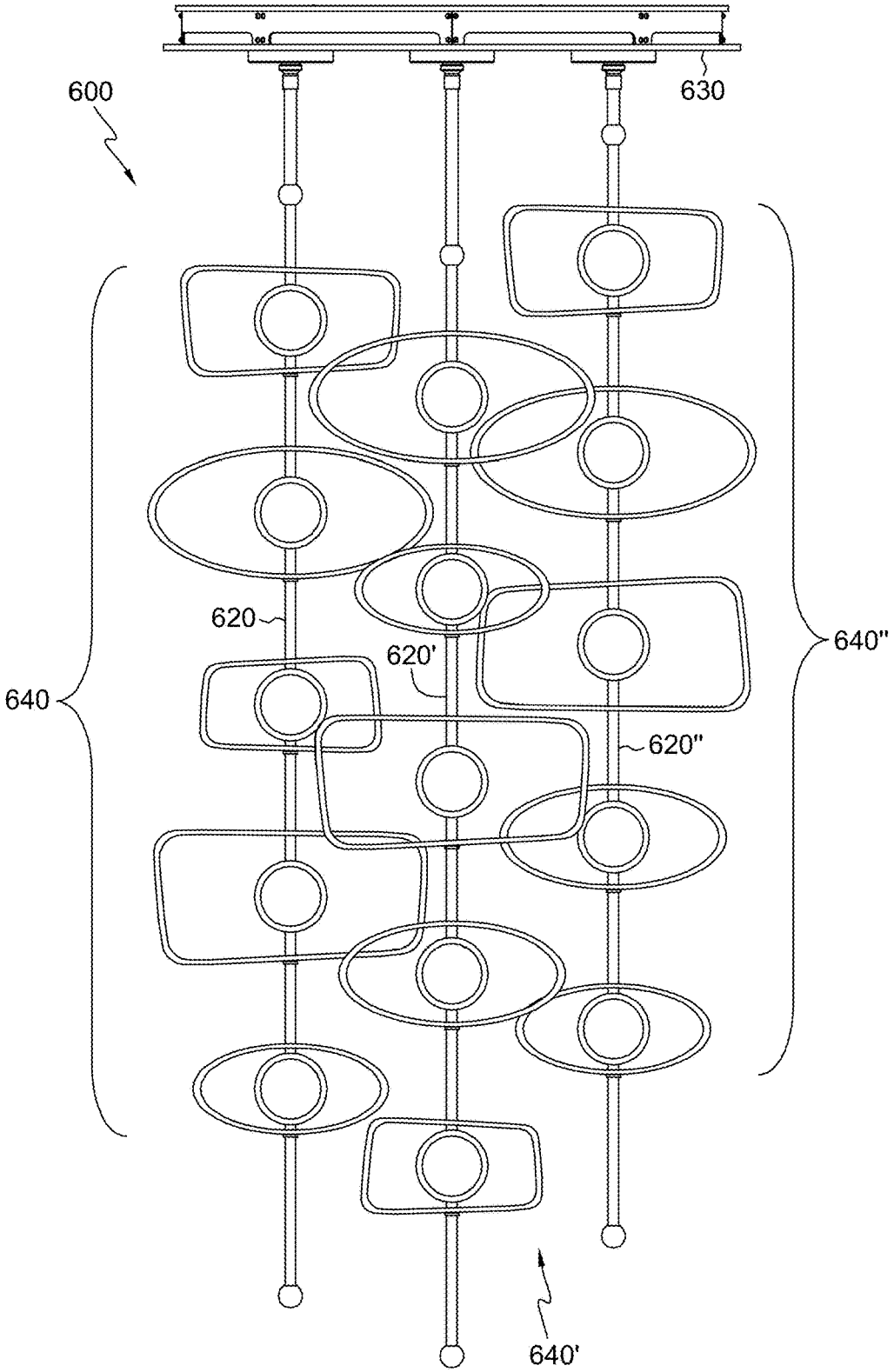
FIG. 19 is a front elevational view of a lighting fixture according to an embodiment of the present disclosure.

FIG. 19 illustrates a lighting fixture 600 such as an overlapping group of hanging pendant lighting fixtures according to an embodiment of the present disclosure. In this illustrated embodiment, lighting fixture 600 may generally include a support member 620, 620", and 620", a round ceiling mount 630, and overlapping groups of a plurality of lighting elements 640, 640' and 640". For example, lighting fixture 600 may have three sets of hanging pendant lighting elements. Wall mount 630 may allow operably attaching the lighting fixture to a ceiling in a similar manner as described above.

Each of lighting elements may generally include a lighting unit and a surrounding member, which may be essentially the same as the lighting units and surrounding members described above. Each of the surrounding members shown in FIG. 19 may have a different configuration and/or size. A portion or component such as one or more of the surrounding members of the lighting elements of lighting fixture 600 may be movable or rotatable and positionable over a range of positions so that the lighting fixture is operable to have a plurality of different configurations. The surrounding members may have a rectangular, or generally rectangular or trapezoidal cross-section with the opposite side not being parallel and vertically disposed planar openings, or an oval cross-section with vertically disposed planar openings. The lighting units may be operably connected to an electrical power supply in a similar manner as described above. The lighting elements may be aligned or staggered relative to the other lighting elements.

Figure 20:
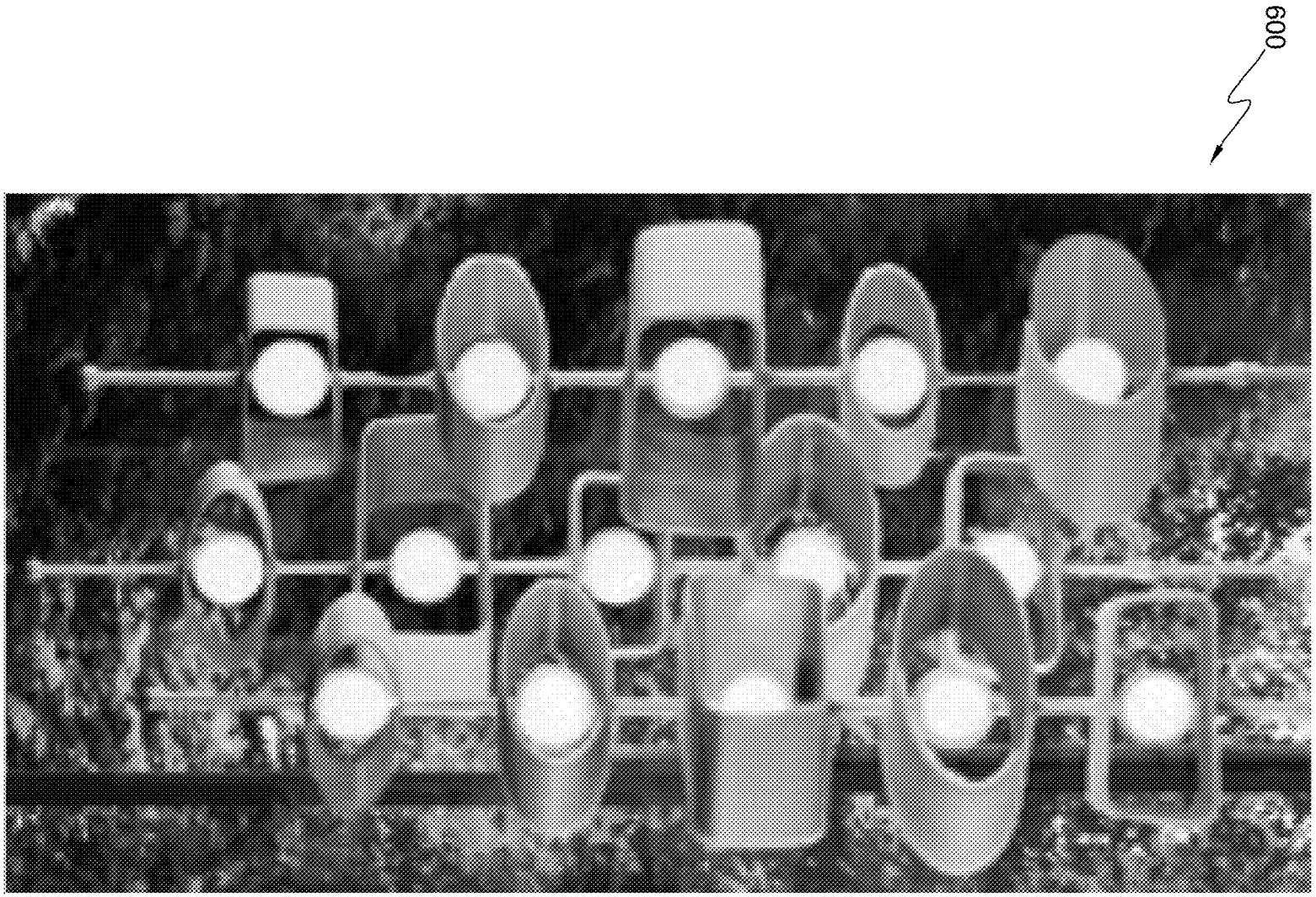
FIG. 20 is a perspective view of the lighting fixture of FIG. 19 illustrated with illumination.
Figure 21:
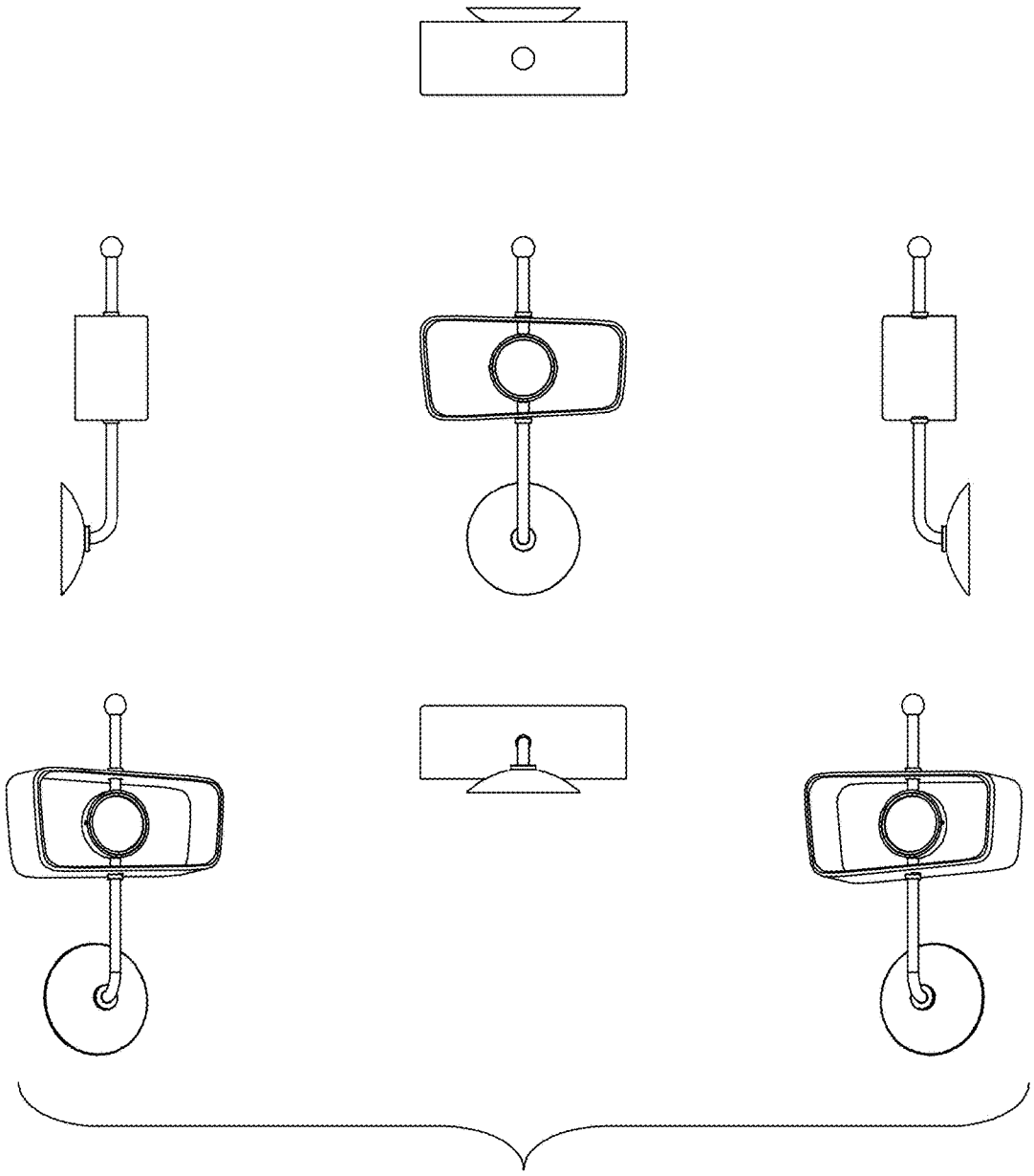
FIGS. 21-24 are perspective, front elevational, right side elevational, left side elevational, top, and bottom views of lighting fixtures according to embodiments of the present disclosure in which the lighting fixtures are configured as wall sconces having a single lighting element.
Figure 22:
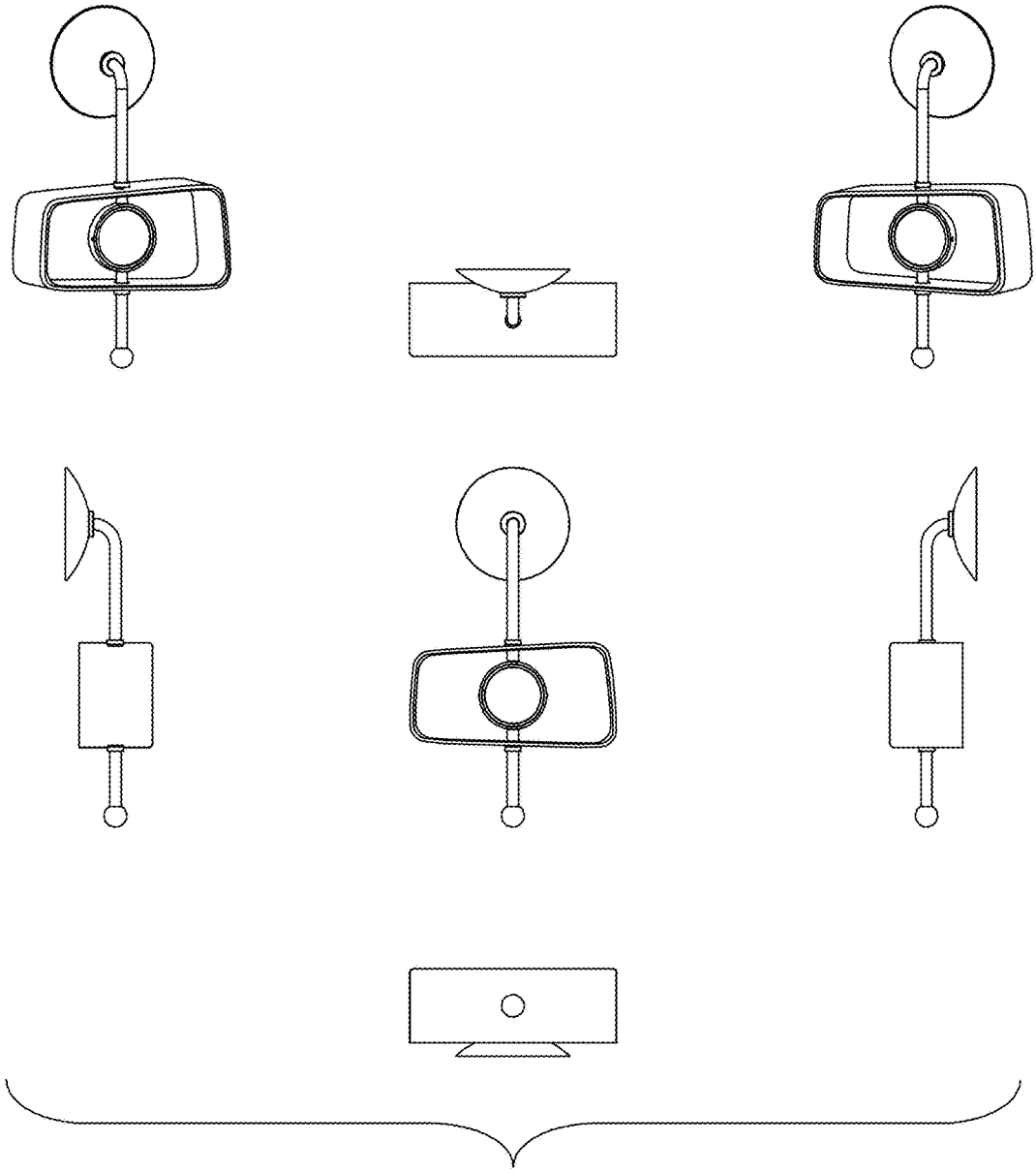
Figure 23:
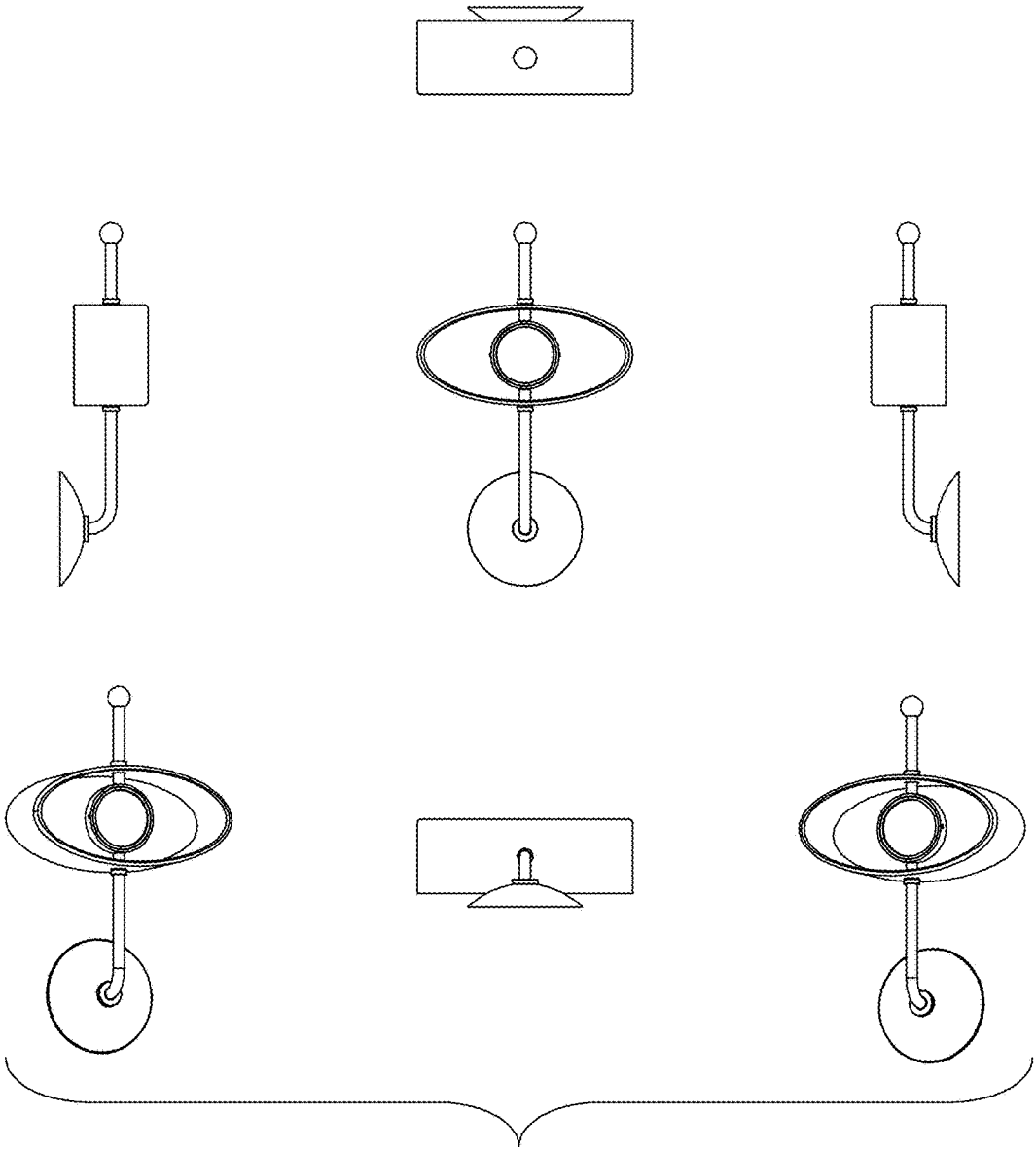
Figure 24:
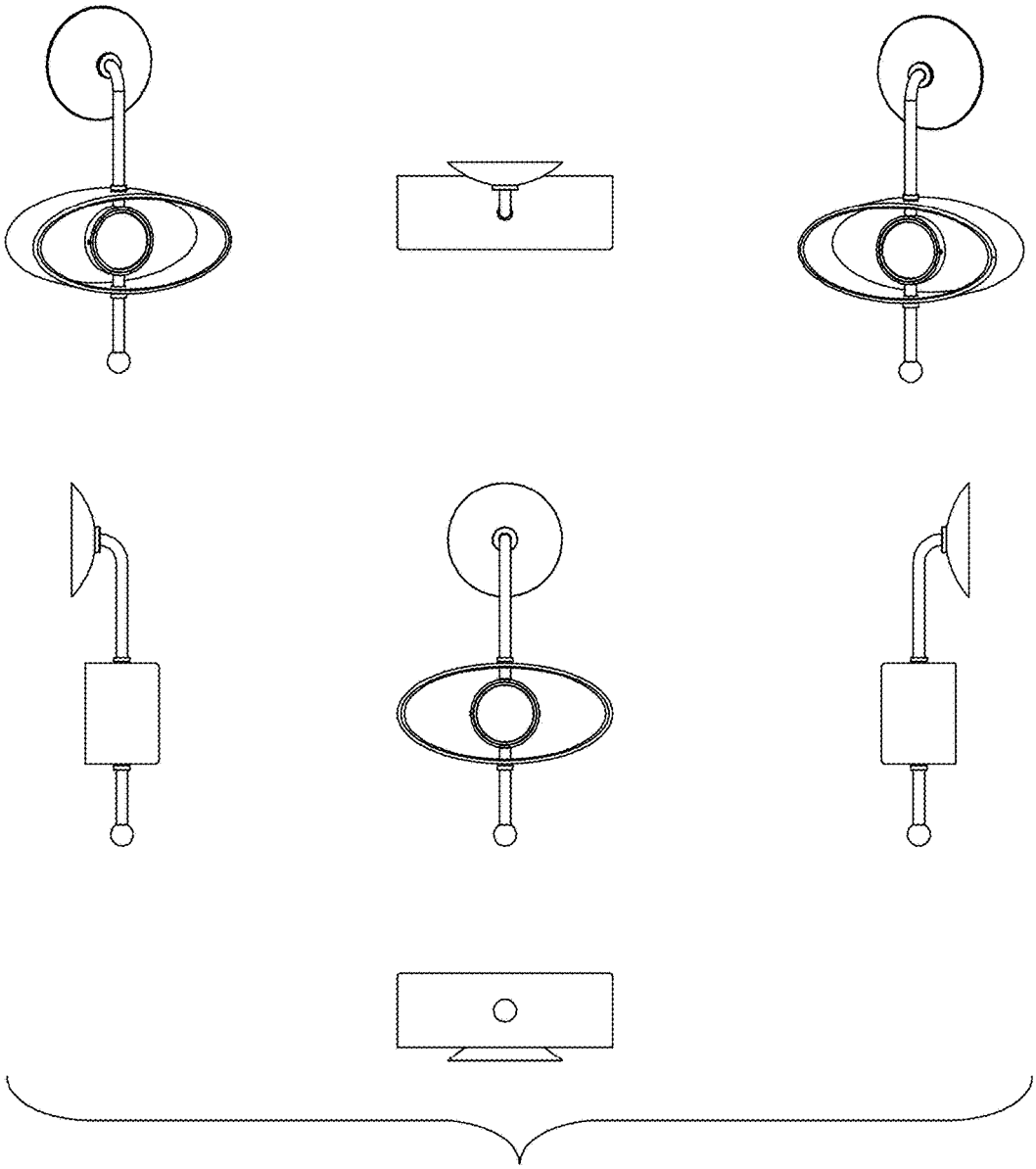

FIG. 20 illustrates lighting fixture 600 with illumination, e.g., with the lighting unit on so that the diffusion members are illuminated (only the front facing diffusion members being shown in FIG. 20). In this illustrated embodiment, inner surfaces of the surrounding members may be a first color, and outer surfaces of surrounding members may be a second color different from the first color. For example, the outer exterior surfaces of the surrounding members may be white or reflective silver, and the inner interior surfaces of the surrounding member may be gold such as reflective gold leaf.

FIGS. 21-24 illustrate lighting fixtures according to embodiments of the present disclosure in which the lighting fixtures are configured as wall sconces having a single lighting element.

Figure 25:
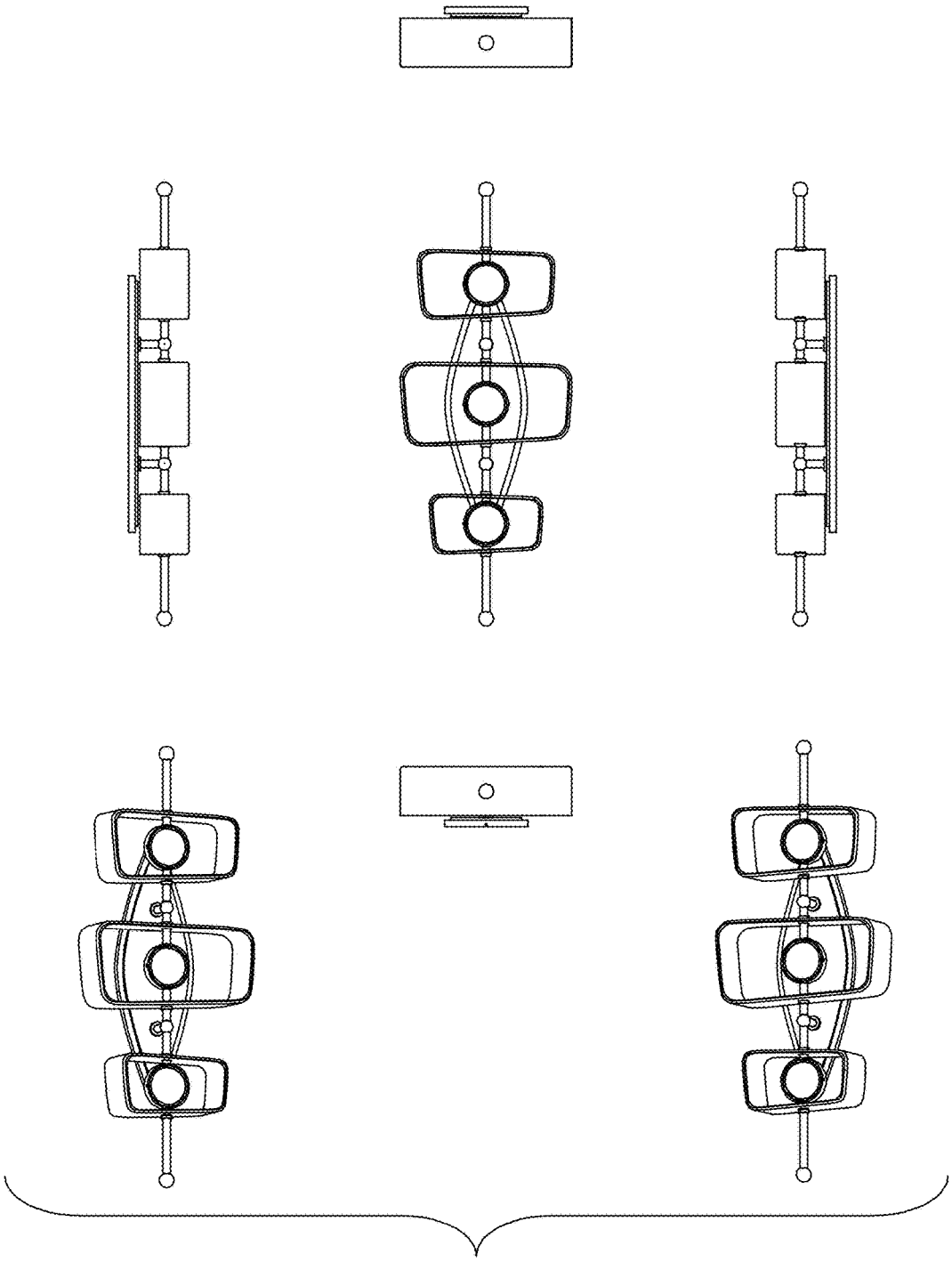
FIGS. 25-27 are perspective, front elevational, right side elevational, left side elevational, top, and bottom views of lighting fixtures according to embodiments of the present disclosure in which the lighting fixtures are configured as wall sconces having a plurality of lighting elements.
Figure 26:
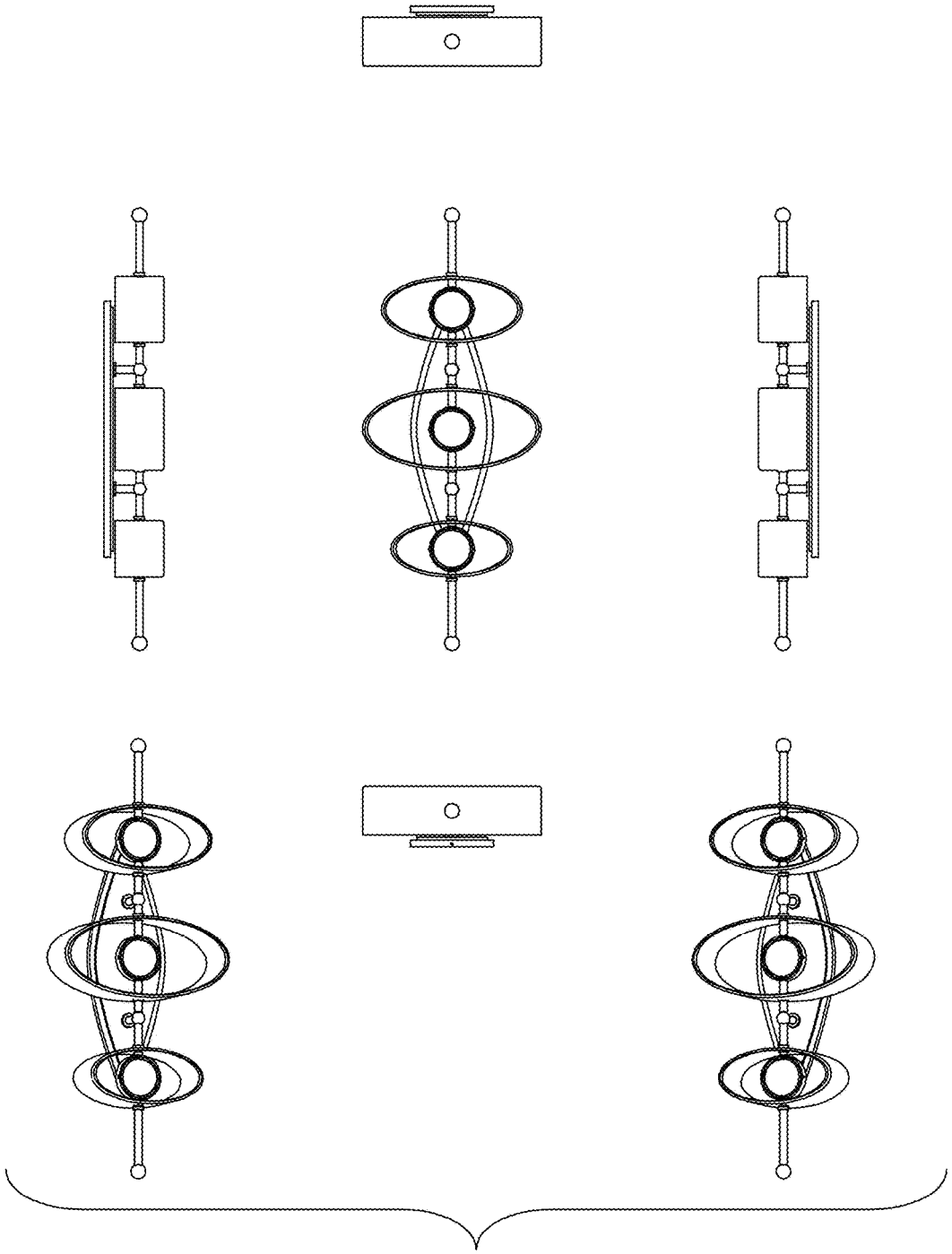
Figure 27:
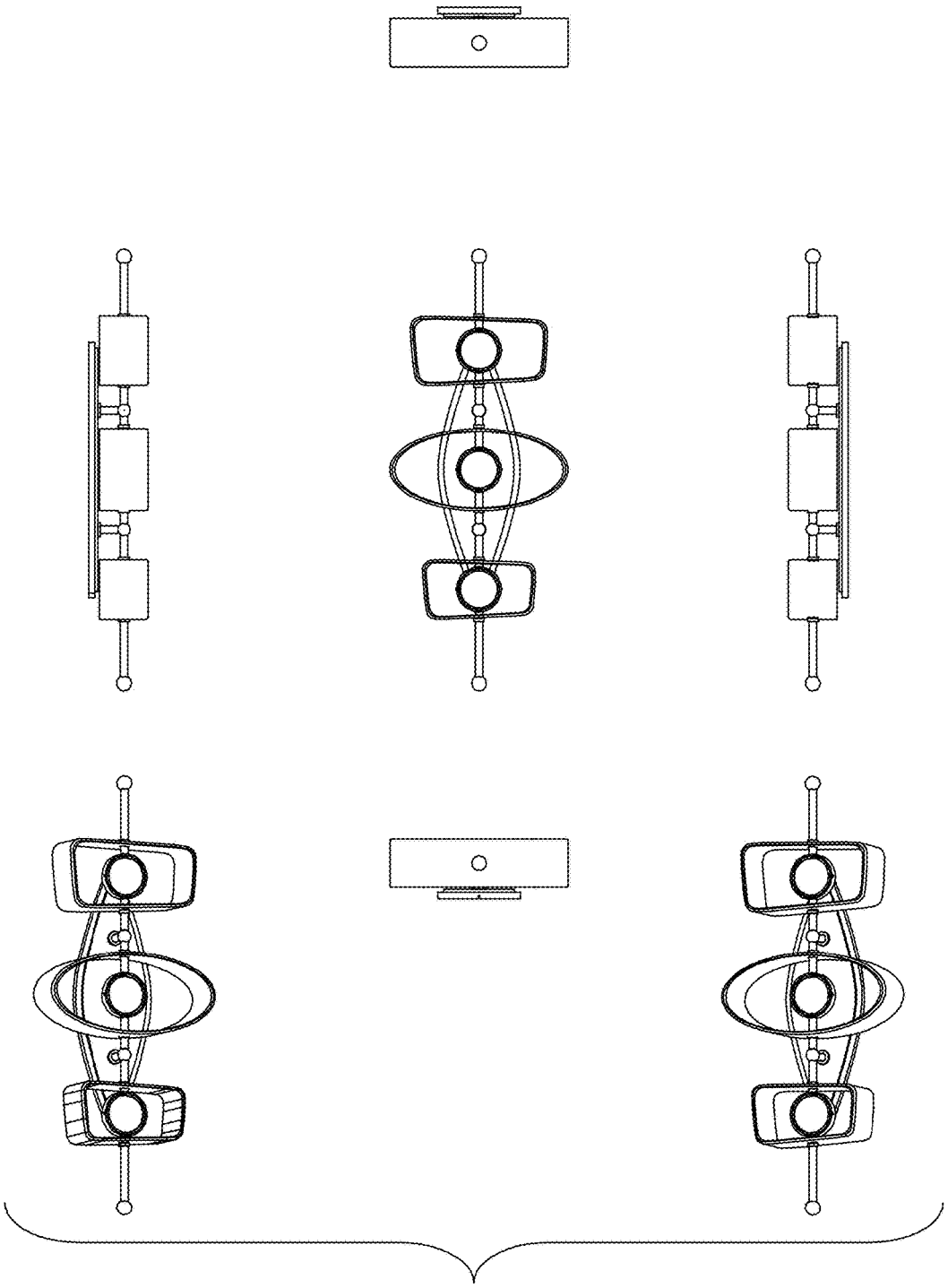

FIGS. 25-27 illustrate lighting fixtures according to embodiments of the present disclosure in which the lighting fixtures are configured as wall sconces having a plurality of lighting elements.

Figure 28:
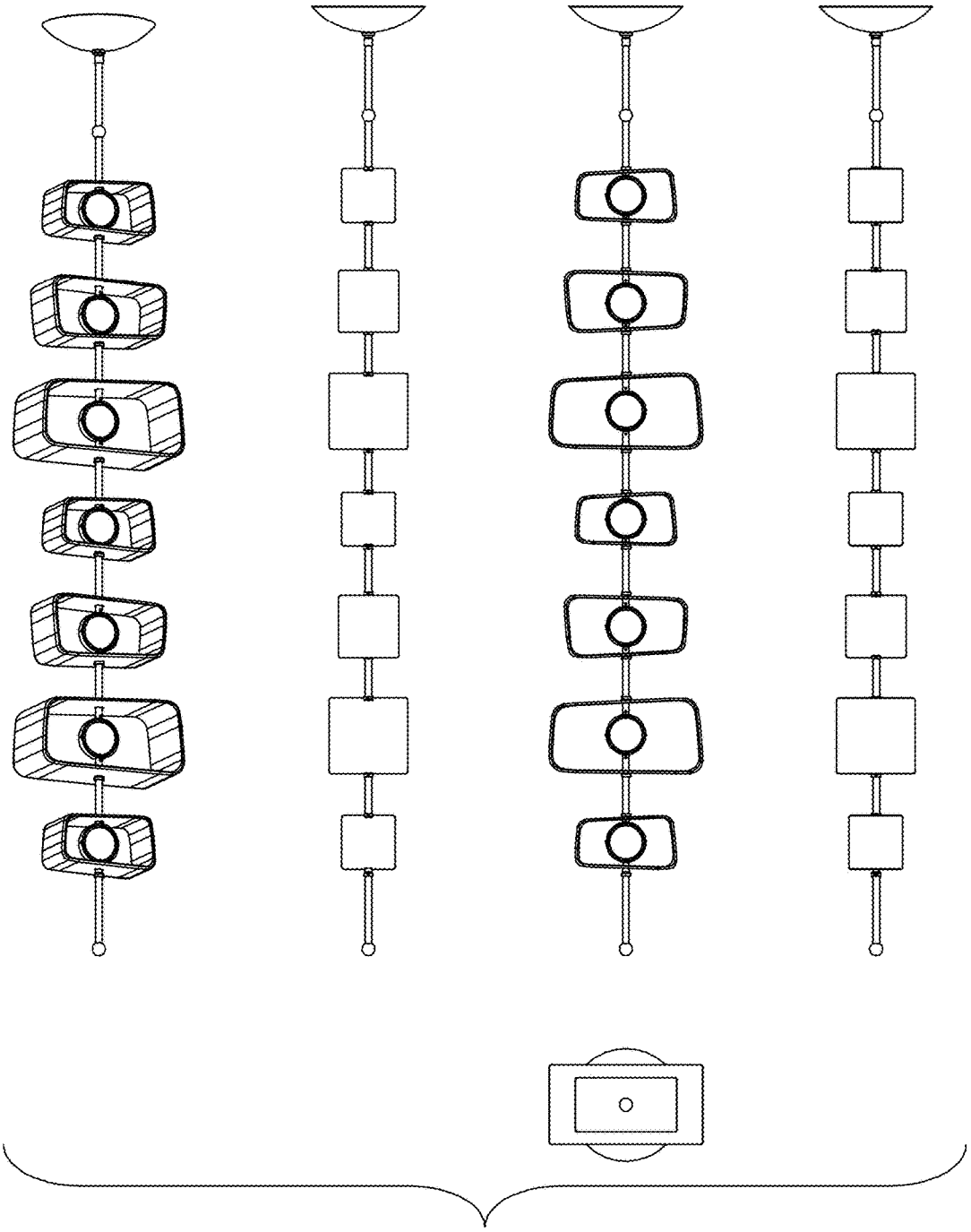
FIG. 28 are a perspective view, a front elevational view (a rear elevational view being a mirror image thereof), a right side elevational view, a left side elevational view, and a bottom view of a lighting fixture according to an embodiment of the present disclosure in which the lighting fixture is configured as pendant having seven lighting elements.

FIG. 28 illustrates a lighting fixture according to an embodiment of the present disclosure in which the lighting fixture is configured as pendant having seven lighting elements.

Figure 29:
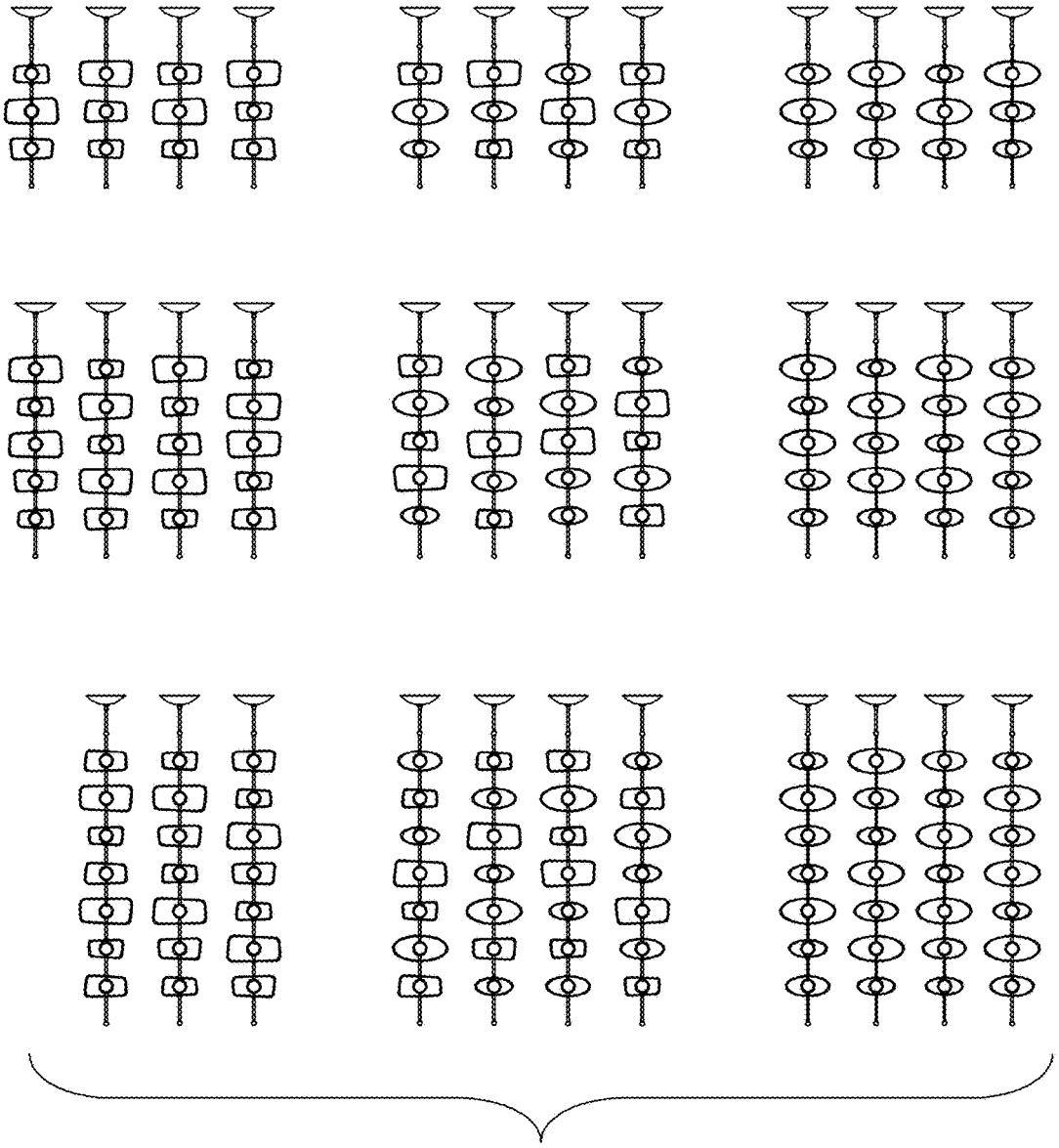
FIG. 29 are front elevational views of lighting fixtures according to embodiments of the present disclosure in which the lighting fixtures are configured as pendants having three, five, or seven lighting elements.

FIG. 29 illustrate lighting fixtures according to embodiments of the present disclosure in which the lighting fixtures are configured as pendants having three, five, or seven lighting elements.

Figure 30:
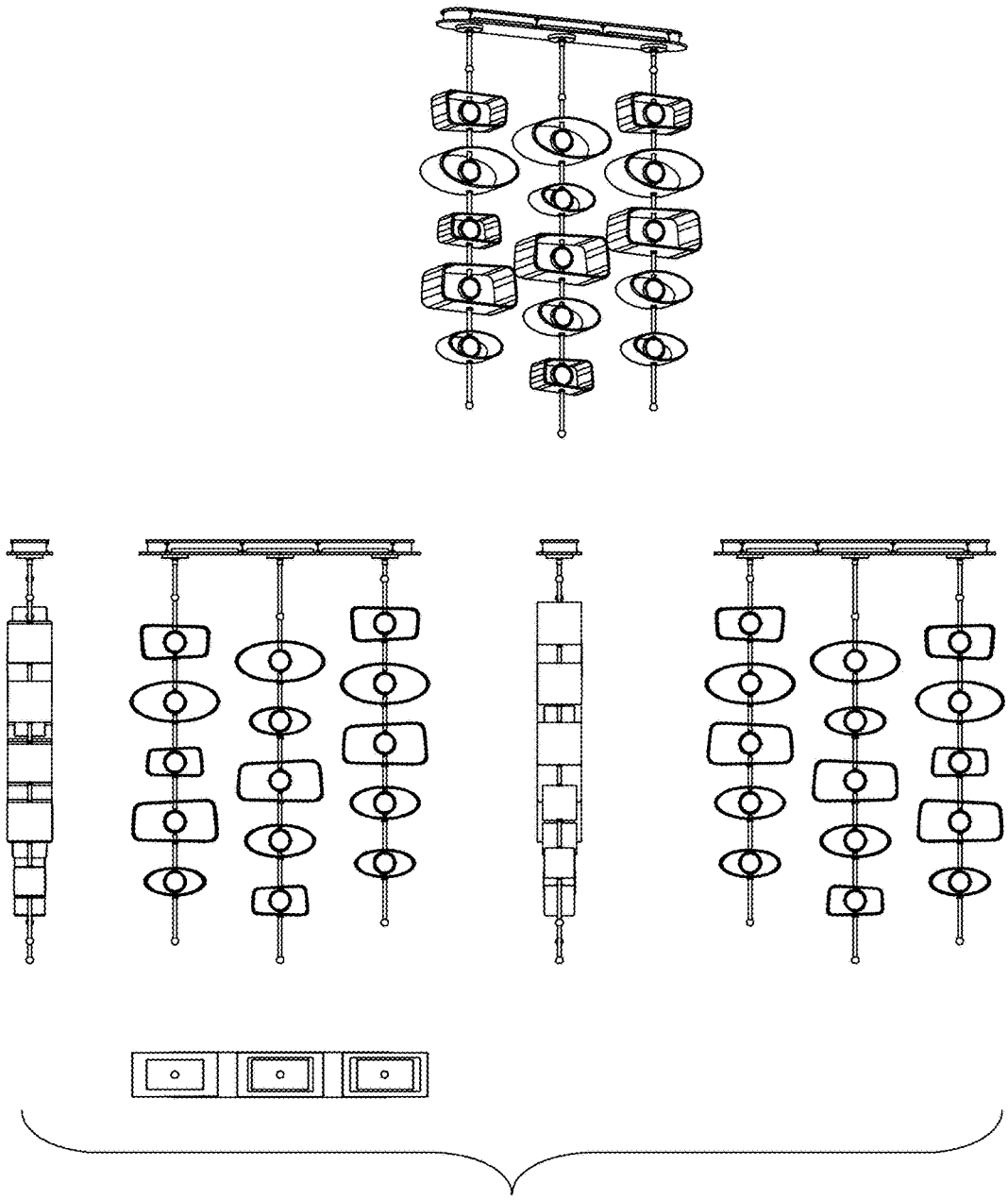
FIG. 30 are a perspective view, a front elevational view, a right side elevational view, a left side elevational view, a rear elevational view, and a bottom view of a lighting fixture according to an embodiment of the present disclosure in which the lighting fixture is configured as a pendant having three aligned sets of five lighting elements.

FIG. 30 illustrate a lighting fixture according to an embodiment of the present disclosure in which the lighting fixture is configured as a pendant having three aligned sets of five lighting elements.

Figure 31:
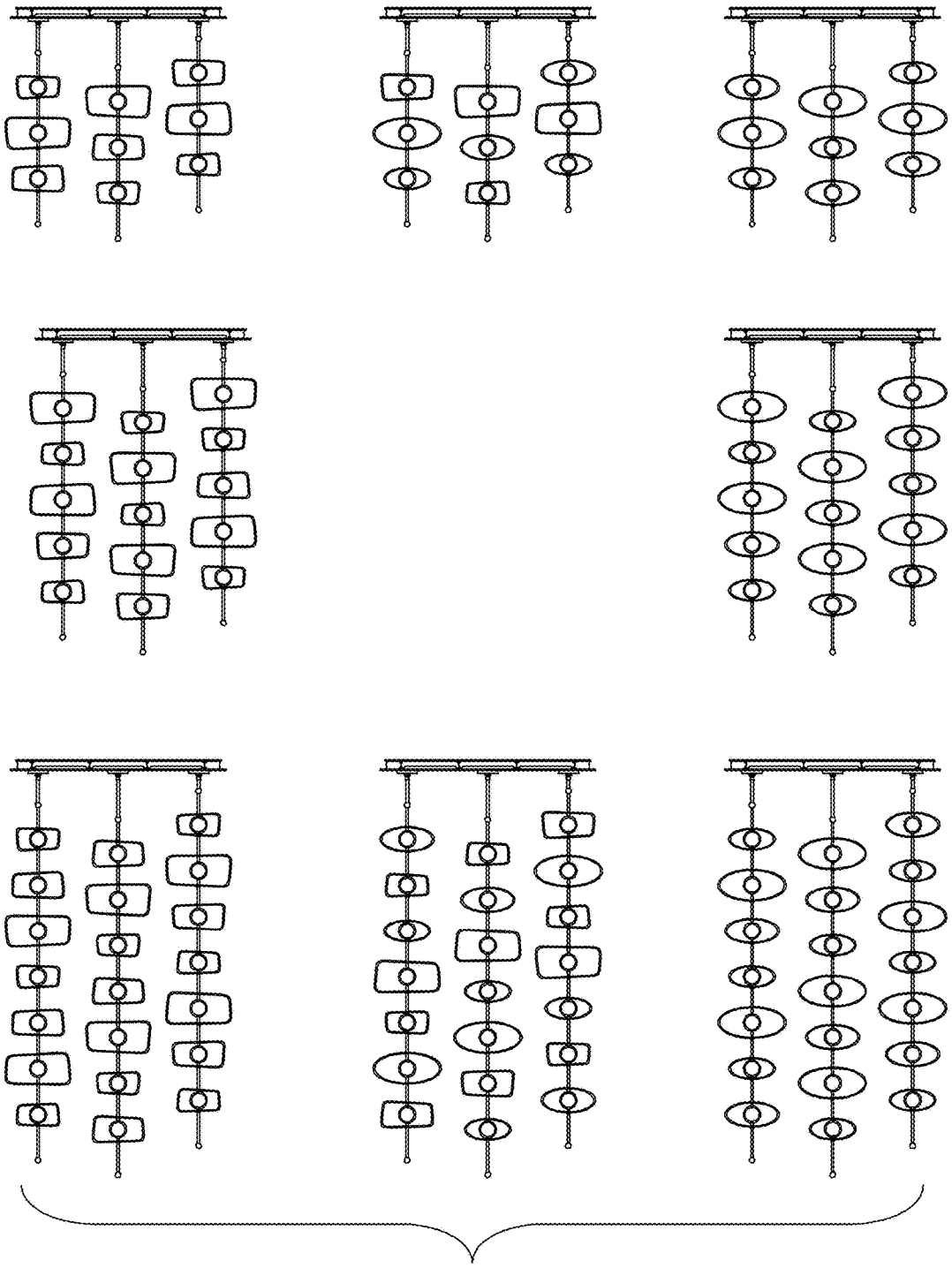
FIG. 31 are front elevational views of lighting fixtures according to embodiments of the present disclosure in which the lighting fixtures are configured as pendants having three aligned sets of three, five, or seven lighting elements.

FIG. 31 illustrate lighting fixtures according to embodiments of the present disclosure in which the lighting fixtures are configured as pendants having three aligned sets of three, five, or seven lighting elements.

Figure 32:
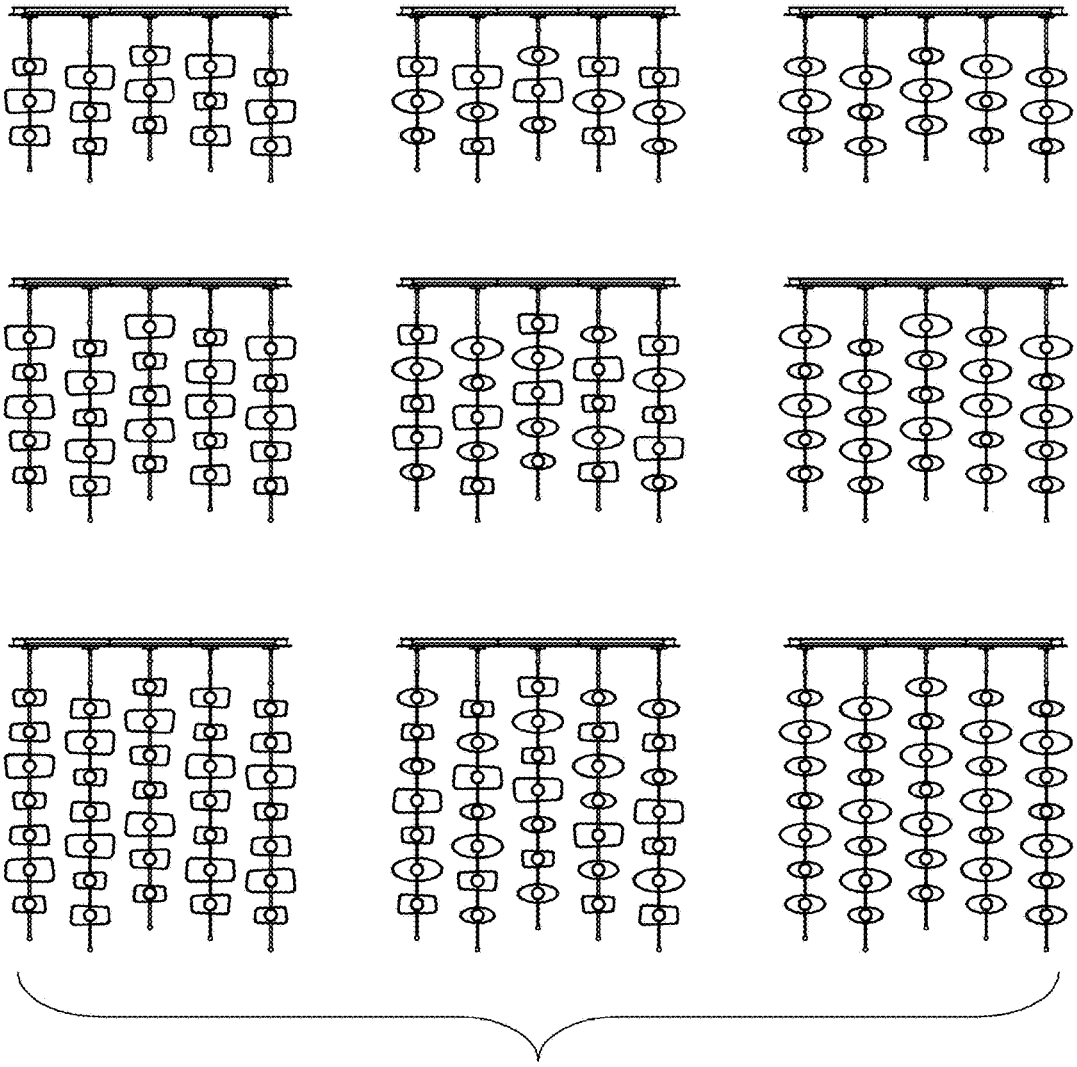
FIG. 32 are front elevational views of lighting fixtures according to embodiments of the present disclosure in which the lighting fixtures are configured as pendants having five aligned sets of three, five, or seven lighting elements.

FIG. 32 illustrate lighting fixtures according to embodiments of the present disclosure in which the lighting fixtures are configured as pendants having five aligned sets of three, five, or seven lighting elements.

Figure 33:
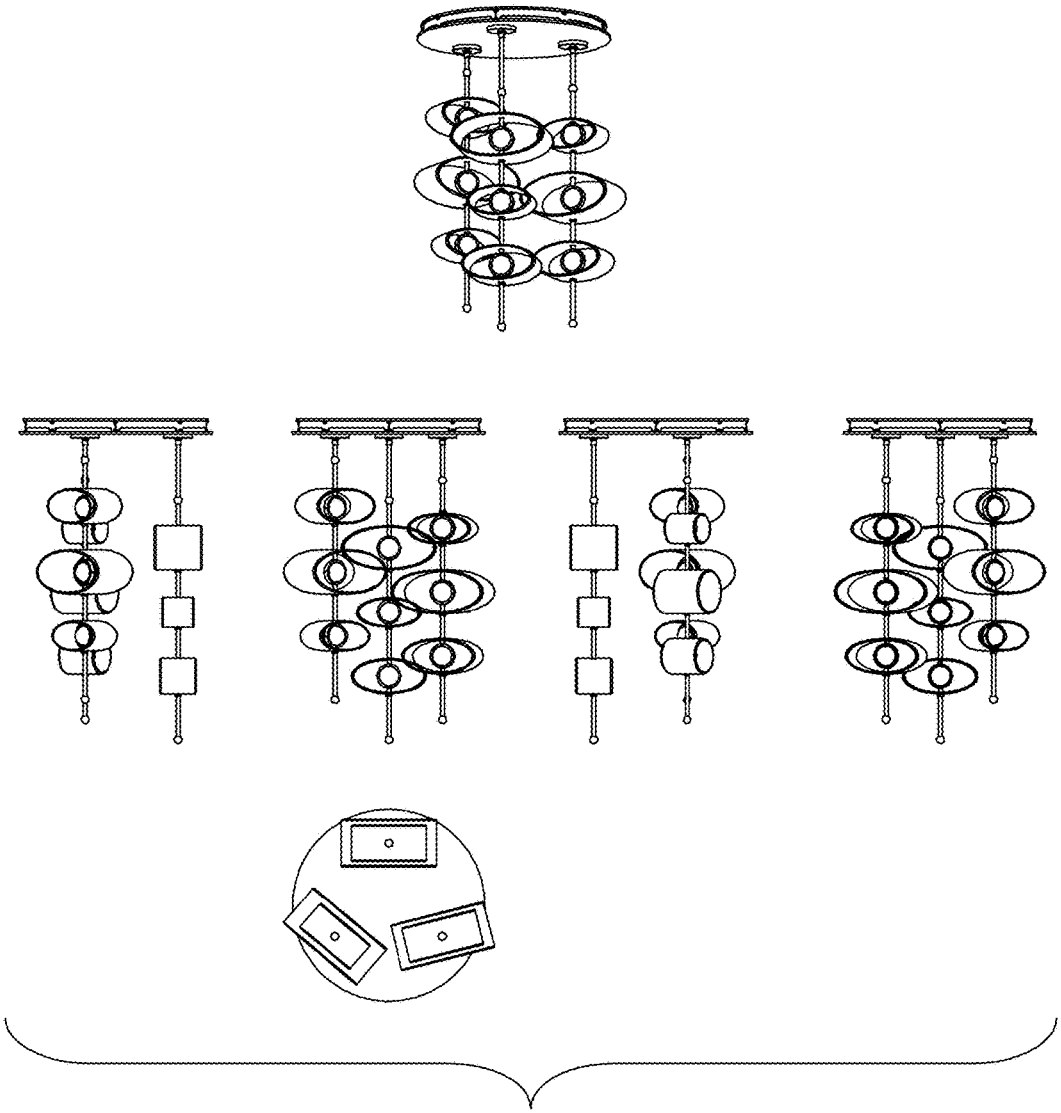
FIG. 33 are a perspective view, a front elevational view, a right side elevational view, a left side elevational view, a rear elevational view, and a bottom view of a lighting fixture according to an embodiment of the present disclosure in which the lighting fixture is configured as a pendant having three sets of three lighting elements arranged along a circle.

FIG. 33 illustrates a lighting fixture according to an embodiment of the present disclosure in which the lighting fixture is configured as a pendant having three sets of three lighting elements arranged along a circle.

Figure 34:
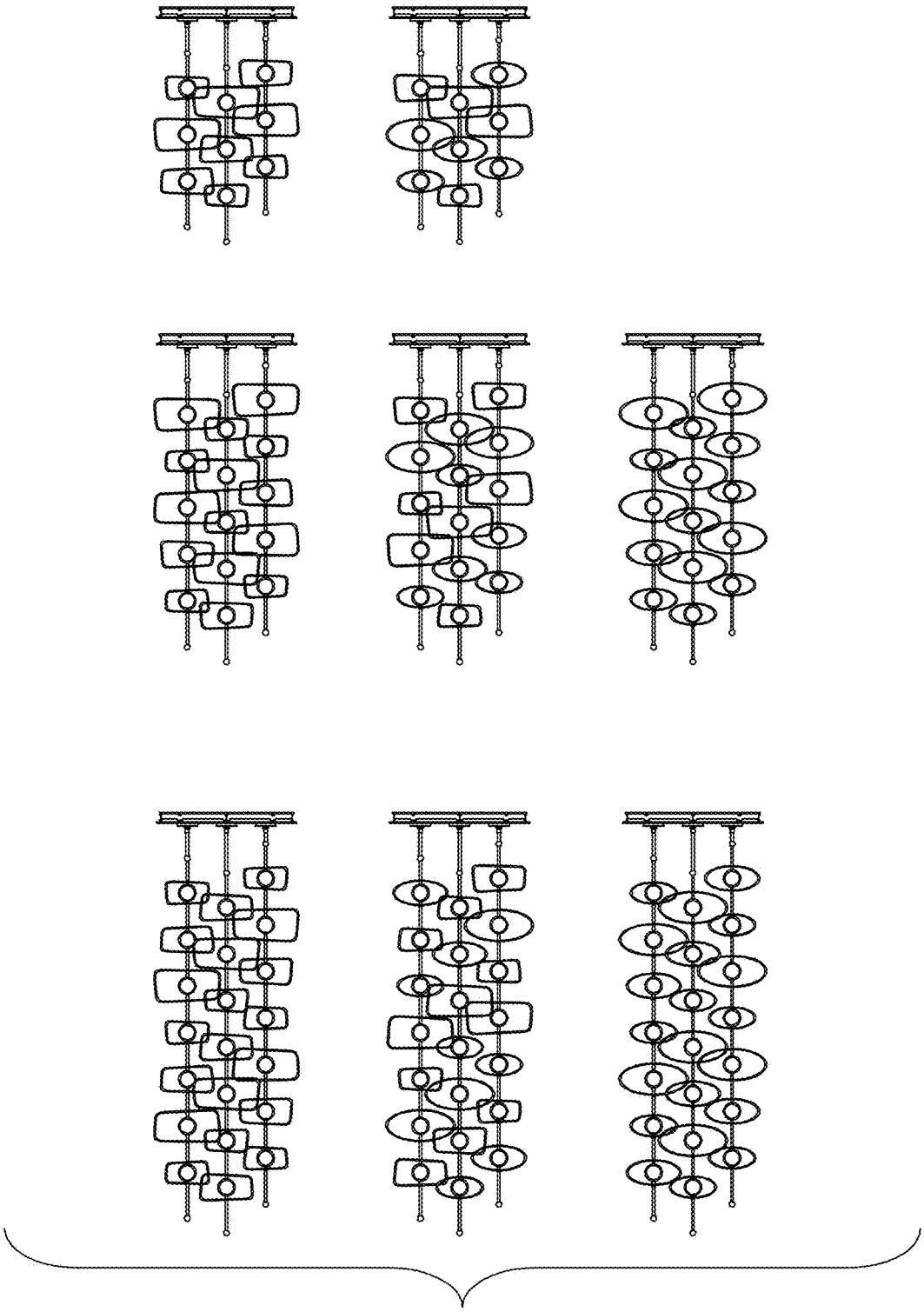
FIG. 34 are front elevational views of lighting fixtures according to embodiments of the present disclosure in which the lighting fixtures are configured as pendants having three sets of three, five, or seven lighting elements arranged along a circle.

FIG. 34 illustrate lighting fixtures according to embodiments of the present disclosure in which the lighting fixtures are configured as pendants having three sets of three, five, or seven lighting elements arranged along a circle.

Figure 35:
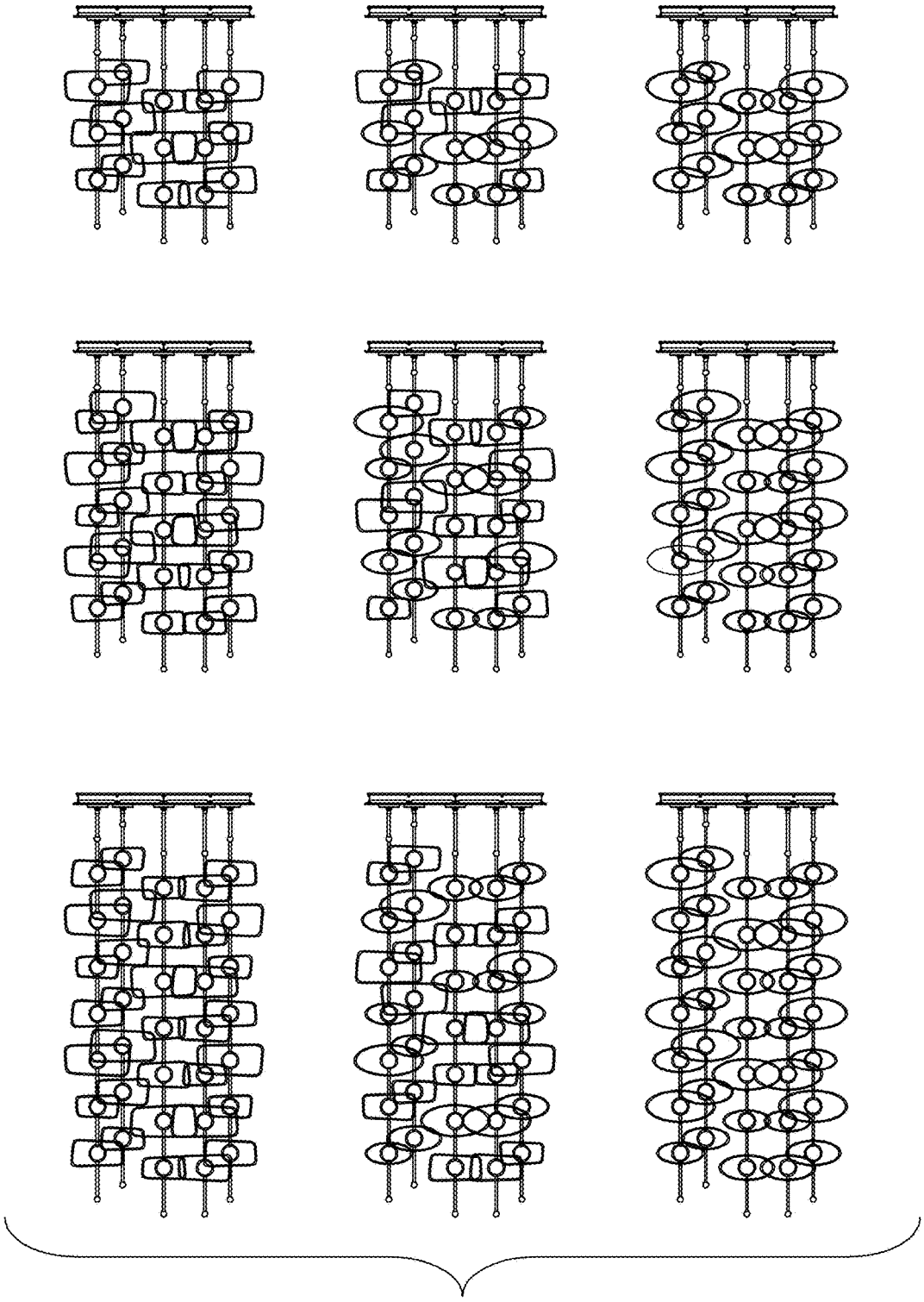
FIG. 35 are front elevational views of lighting fixtures according to embodiments of the present disclosure in which the lighting fixtures are configured as pendants having five sets of three, five, or seven lighting elements arranged along a circle.

FIG. 35 illustrate lighting fixtures according to embodiments of the present disclosure in which the lighting fixtures are configured as pendants having five sets of three, five, or seven lighting elements arranged along a circle.

From the present description, it will be appreciated that the surrounding members may be formed from an opaque or non-translucent material. In other embodiments, the surrounding members may be translucent or transparent. The surrounding members may be continuous surrounding members that extend completely around the lighting unit. The surrounding members may be a non-continuous members, e.g., not extend along the entire length around the lighting unit. For example, the surrounding members may extend around about 50 percent, about 60 percent, about 70 percent, about 80 percent, about 90 percent, or other suitable amount around the lighting unit. The surrounding members may be solid or have one or more openings through the thickness of the surrounding members. In some embodiments, the surrounding members may be a plurality of spaced apart surrounding members along the depth of the surrounding members. In some embodiments, the surrounding members may be a plurality of generally concentrically disposes spaced apart surrounding members. The surrounding members may define planar inner and outer openings, which planar openings may be disposed vertically, or at an angle of about 10 degrees, 20 degrees, 30 degrees, 40 degrees, 50 degrees, 60 degrees, 70 degrees, or 80 degrees to the vertical. For example, the upper portion of the surrounding members may have a greater depth than the depth of the lower portion of the surrounding members, or the lower portion of the surrounding members may have a greater depth than the depth of the upper portion of the surrounding members, or one side may have a greater depth and the depth of the other side of the surrounding members. In some embodiments, the left and right sides may have different depths.

The surrounding members may be formed from a metallic material such as aluminum, brass, copper, steel, bronze, a plastic material, or other suitable material and combination thereof. Other suitable sizes and configurations for the surrounding members such as having a symmetric circular cross-section or unsymmetrical or irregular circular cross-section, an equilateral triangular cross-section, right triangular cross-section, irregular triangular cross-section, a symmetric square cross-sections or unsymmetrical or irregular square cross-section, symmetric diamond cross-sections or unsymmetrical or irregular diamond cross-section, etc. may be employed. Other suitable sizes and configurations for the lighting unit may be employed. In lighting fixtures having a plurality of lighting element, the lighting elements may have the same general cross-sectional shape, two or more different general cross-sectional shapes, or each of the plurality of lighting elements have a different general cross-sectional shape. In lighting fixtures having a plurality of lighting element, the lighting elements may be the same size, two or more may have the same size, or each of the plurality of lighting elements may be a different size.

The lighting units may be integral with or not integral with the support members. The lighting units may be disposed in the middle or offset from of the middle of the surrounding members. In lighting fixtures having a plurality of lighting element, the lighting units may have the same size and shape, two or more may have different sizes and shapes, or each of the plurality of lighting units may have different size and shapes. In the lighting fixtures, the lighting units may emit light forward and backward, only forward, only backward, and in lighting fixtures having a plurality of lighting elements, the lighting units may emit light forward and backward, some forward and some backward, and other suitable combinations. The lighting fixtures may include lighting units fixed and aligned in a single direction along the support member, or the lighting units may be configured so the lighting units are rotatable or separately and independently rotatable about the axis of the supporting members. In other embodiments, the support member, lighting elements may have a fixed configuration relative to each other, and the lighting unit and surrounding member having a fixed configuration relative to each other.

The support members may have a generally straight configuration, or may have a not-straight, curves or angled configuration.

The lighting fixtures when installed and supported from a wall or ceiling and observed by an observer such as standing on the ground, may provide a lighting unit centrally disposed within a generally vacant area in the surrounding members. The lighting fixtures having a plurality of lighting elements when installed and supported from a wall or ceiling and observed by an observer such as standing on the ground, may provide a series of equally spaced apart or non-equally spaced apart lighting units disposed along the support members.

It is to be understood that the above description is intended to be illustrative, and not restrictive. For example, the above-described embodiments and/or aspects thereof may be used in combination with each other. In addition, many modifications may be made to adapt a particular situation or material to the teachings of the various embodiments without departing from their scope.

While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), and "contain" (and any form contain, such as "contains" and "containing") are open-ended linking verbs. As a result, a method or device that "comprises", "has", "includes" or "contains" one or more steps or elements possesses those one or more steps or elements, but is not limited to possessing only those one or more steps or elements. Likewise, a step of a method or an element of a device that "comprises", "has", "includes" or "contains" one or more features possesses those one or more features, but is not limited to possessing only those one or more features. Furthermore, a device or structure that is configured in a certain way is configured in at least that way, but may also be configured in ways that are not listed.

Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the disclosure has been described in detail in connection with only a limited number of embodiments, it should be readily understood that the disclosure is not limited to such disclosed embodiments. Rather, the disclosure can be modified to incorporate any number of variations, alterations, substitutions, or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

This written description uses examples in the present disclosure, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A lighting fixture comprising:

an elongated vertically disposed support having a first end portion and a second end portion and defining a vertically disposed axis, said elongated support operably attachable to a wall or a ceiling;

at least one lighting element comprising:

a lighting unit operably connected to said elongated support between said first end portion and said second end portion;

a continuous surrounding member having an inner surface and an outer surface defining a first opening and a second opening, said inner surface defining a cavity therein between said first opening and said second opening, and said first opening and said second opening defining a central axis extending therethrough, said central axis disposed at a non-parallel angle relative to said vertically disposed axis;

said elongated support extending through a first portion of said surrounding member spaced from said first opening and spaced from said second opening and extending through a second portion of said surrounding member spaced from said first opening and spaced from said second opening; and said lighting unit disposed in said cavity and spaced from said inner surface of said surrounding member to define a surrounding vacant area between said lighting unit and said inner surface of said surrounding member.

2. The lighting fixture of claim 1 wherein said surrounding member is adjustably positionable about said vertically disposed axis.

3. The lighting fixture of claim 1 wherein said central axis is disposed at a right angle relative to said vertically disposed axis.

4. The lighting fixture of claim 3 wherein said first opening comprises a vertically disposed planar opening, and said second opening defines a vertically disposed planar opening.

5. The lighting fixture of claim 1 wherein said at least one lighting element comprises a plurality of said lighting elements spaced apart and connected to said elongated support between said first end and said second end.

6. The lighting fixture of claim 5 wherein at least two of the plurality of lighting elements having different surrounding members.

7. The lighting fixture of claim 6 wherein at least one of said plurality of surrounding members comprises an oval configuration, and at least one of said plurality of surrounding members comprises a rectangular or trapezoidal configuration.

8. The lighting fixture of claim 7 wherein said plurality of surrounding members is independently adjustably positionable about said vertically disposed axis.

9. The lighting fixture of claim 1 wherein said surrounding member comprises a thin flat surrounding member.

10. The lighting fixture of claim 1 wherein said surrounding member is opaque.

11. The lighting fixture of claim 1 wherein said lighting unit comprises a spherical lighting unit.

12. The lighting fixture of claim 11 wherein said lighting unit comprises a curved diffusion member.

13. The lighting fixture of claim 12 wherein said lighting unit comprises a circular opaque band, said elongated support being operably attached to a first portion of said band and operably attached to a second portion of said band.

14. The lighting fixture of claim 12 wherein said surrounding member comprises a width, and said width being greater than said depth.

15. The lighting fixture of claim 1 wherein said surrounding member comprises a depth between said first opening and said second opening, and said depth being greater than the size of said lighting unit.

16. The lighting fixture of claim 1 wherein said surrounding member is unsymmetrical about said central axis.

17. The lighting fixture of claim 1 wherein said inner surface of said surrounding member comprises a first color, said outer surface of said surrounding member comprises a second color, and said first color being different from said second color.

18. The lighting fixture of claim 17 wherein said inner surface of said surrounding member comprises a reflective metallic surface.

19. The lighting fixture of claim 1 wherein said first opening and said second opening of said surrounding member comprises an oval, a rectangle, a trapezoid, or a polygon cross-section.

20. The lighting fixture of claim 1 wherein said lighting fixture comprises a wall sconce or a hanging pendant.

21. The lighting fixture of claim 1 wherein:

said surrounding member comprises a continuous thin flat opaque surrounding member;

said surrounding member comprises a depth between said first opening and said second opening, and said depth being greater than the size of said lighting unit;

said surrounding member comprises a width, and said width being greater than said depth; and said central axis comprises a horizontally disposed axis.

22. The lighting fixture of claim 21 wherein said surrounding member is adjustably positionable about said vertically disposed axis.

23. The lighting fixture of claim 21 wherein said central axis is disposed at a right angle relative to said vertically disposed axis.

24. The lighting fixture of claim 21 wherein said first opening comprises a vertically disposed planar opening, and said second opening comprises a vertically disposed planar opening.

25. The lighting fixture of claim 21 wherein said first opening and said second opening of said surrounding member comprises an oval, a rectangle, a trapezoid, or a polygon.

26. The lighting fixture of claim 21 wherein:

said inner surface of said surrounding member comprises a first color, said outer surface of said surrounding member comprises a second color, and said first color being different from said second color.

27. The lighting fixture of claim 1 wherein said at least one lighting element comprises a plurality of said lighting elements spaced apart and connected to said elongated support between said first end and said second end of said elongated support, each of said plurality of said lighting elements comprising:

said surrounding member comprising a continuous thin flat opaque surrounding member;

said surrounding member comprising a depth between said first opening and said second opening, and said depth being greater than the size of said lighting unit;

said surrounding member comprising a width, and said width being greater than said depth; and said central axis comprising a horizontally disposed axis.

28. The lighting fixture of claim 27 wherein said surrounding members are independently adjustably positionable about said vertically disposed axis.

29. The lighting fixture of claim 27 wherein said central axes are disposed at a right angle relative to said vertically disposed axis.

30. The lighting fixture of claim 27 wherein said first openings comprises vertically disposed planar openings, and said second openings comprise a vertically disposed planar openings.

31. The lighting fixture of claim 27 wherein said first openings and said second openings of said surrounding members comprise an oval, a rectangle, a trapezoid, or a polygon.

32. The lighting fixture of claim 27 wherein:

said inner surfaces of said surrounding members comprise a first color, said outer surfaces of said surrounding members comprise a second color, and said first color being different from said second color.

33. The lighting fixture of claim 27 wherein said plurality of lighting elements being equally spaced apart along said elongated support.

34. The lighting fixture of claim 27 wherein said surrounding member of at least two of said plurality of lighting elements being different.

35. The lighting fixture of claim 34 wherein at least one of said plurality of surrounding members comprises an oval cross-section, and at least one of said plurality of surrounding members comprises a rectangle or trapezoid cross-section.

36. A method comprising:

independently adjustably positioning the plurality surrounding members relative to the vertically disposed axis of the lighting fixture of claim 27 attached to the wall or the ceiling.

37. The lighting fixture of claim 1 further comprising a ceiling mount, and wherein said lighting fixture comprises a plurality of spaced apart lighting fixtures attachable to said ceiling mount, each of said plurality of lighting fixtures comprising a plurality of said lighting elements spaced apart and connected to said elongated supports between said first ends and said second ends of said elongated supports, each of said plurality of said lighting elements comprising:

said surrounding member comprising a continuous thin flat opaque surrounding member;

said surrounding member comprising a depth between said first opening and said second opening, and said depth being greater than the size of said lighting unit;

said surrounding member comprising a width, and said width being greater than said depth; and said central axis comprising a horizontally disposed axis.

38. A method comprising:

attaching the elongated support of the lighting fixture of claim 1 to a wall or to a ceiling; and adjustably positioning the surrounding member relative to the vertically disposed axis of the lighting fixture.

39. The lighting fixture of claim 1, wherein:

said elongated support extends through the first portion of said surrounding member spaced from said first opening and spaced from said second opening, extends through said cavity, and extends through a second portion of said surrounding member spaced from said first opening and spaced from said second opening;

said lighting unit disposed in said cavity and spaced from said inner surface of said surrounding member to define a surrounding vacant area extending between said lighting unit and said inner surface of said surrounding member and extending from said first opening to said second opening; and wherein an observer standing on the ground is operable to view said surrounding vacant area around said lighting unit from said first opening to said second opening of said surrounding member when said lighting fixture is supported from the wall or the ceiling.

40. The lighting fixture of claim 39 wherein said surrounding member is adjustably positionable about said vertically disposed axis.

41. The lighting fixture of claim 39 wherein:

said surrounding member comprises a thin flat surrounding member; and said surrounding member is opaque.

42. The lighting fixture of claim 39 wherein:

said lighting unit comprises a spherical lighting unit.

43. The lighting fixture of claim 39 wherein:

said surrounding member is adjustably positionable about said vertically disposed axis;

said surrounding member comprises a thin flat surrounding member;

said surrounding member is opaque; and said lighting unit comprises a spherical lighting unit.

44. The lighting fixture of claim 39 further comprising a ceiling or a wall mount attachable to said first end of said elongated support, and wherein said at least one lighting element comprises a plurality of said lighting elements spaced apart and connected to said elongated support between said first end and said second end.

45. The lighting fixture of claim 44 wherein:

said plurality of surrounding members is adjustably positionable about said vertically disposed axis;

said plurality of surrounding members comprise a plurality of thin flat surrounding members;

said plurality of surrounding members is opaque; and said plurality of lighting units comprise a plurality of spherical lighting units.

46. The lighting fixture of claim 39 further comprising a ceiling mount, and wherein said lighting fixture comprises a plurality of spaced apart said lighting fixtures attachable to said ceiling mount, each of said plurality of spaced apart said lighting fixtures comprising a plurality of said lighting elements spaced apart and connected to said elongated support between said first end and said second end of said elongated supports.

47. The lighting fixture of claim 46 wherein:

said plurality of surrounding members is adjustably positionable about said vertically disposed axis;

said plurality of surrounding members comprise a plurality of thin flat surrounding members;

said plurality of surrounding members is opaque; and said plurality of lighting units comprise a plurality of spherical lighting units.

48. A method comprising:

attaching the elongated support of the lighting fixture of claim 39 to a wall or to a ceiling; and adjustably positioning the surrounding member relative to the vertically disposed axis of the lighting fixture.

49. A method comprising:

independently adjustably positioning the plurality surrounding members relative to the vertically disposed axis of the lighting fixture of claim 44 attached to the wall or the ceiling.

* * * * *